US010455653B1

(12) United States Patent
Watanabe et al.

(10) Patent No.: US 10,455,653 B1
(45) Date of Patent: Oct. 22, 2019

(54) LED DRIVING CIRCUITS

(71) Applicant: InnoLux Corporation, Miao-Li County (TW)

(72) Inventors: Hidetoshi Watanabe, Miao-Li County (TW); Kazuyuki Hashimoto, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/255,208

(22) Filed: Jan. 23, 2019

Related U.S. Application Data

(60) Provisional application No. 62/716,908, filed on Aug. 9, 2018.

(51) Int. Cl.
*G09G 3/32* (2016.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/08; H05B 33/0815; H05B 33/0845; H05B 37/02; G09G 3/32; G09G 3/325; G09G 3/3225; G09G 3/34; G09G 3/342
See application file for complete search history.

(56) References Cited

U.S. PATENT DOCUMENTS

| | | | | |
|---|---|---|---|---|
| 6,501,230 | B1 * | 12/2002 | Feldman | G09G 3/3216 315/169.3 |
| 2009/0289559 | A1 * | 11/2009 | Tanaka | H05B 33/0815 315/185 R |
| 2011/0199011 | A1 * | 8/2011 | Nakazawa | G09G 3/342 315/193 |
| 2015/0245433 | A1 * | 8/2015 | McCune, Jr. | H05B 33/0851 315/294 |
| 2017/0027034 | A1 * | 1/2017 | Nozawa | H05B 33/0842 |
| 2018/0070417 | A1 * | 3/2018 | Galvano | H05B 33/0827 |
| 2018/0182279 | A1 | 6/2018 | Sakariya et al. | |

* cited by examiner

*Primary Examiner* — Thai Pham
(74) *Attorney, Agent, or Firm* — McClure, Qualey & Rodack, LLP

(57) ABSTRACT

An LED driving circuit for illuminating a first LED unit is provided. The LED driving circuit includes: a data latch circuit, a current source, and a PWM circuit. The data latch circuit latches a data signal according to a first latch signal to generate a first control signal. The current source generates a constant current. The PWM circuit periodically passes the constant current through the first LED unit according to the first control signal and an enable signal.

20 Claims, 20 Drawing Sheets

LED DRIVING CIRCUITS

CROSS REFERENCE TO RELATED APPLICATIONS

This application claims the benefit of U.S. Provisional Application No. 62/716,908, filed on Aug. 9, 2018, the entirety of which is incorporated by reference herein.

BACKGROUND

Field

The disclosure relates generally to circuits for driving LED units, and more particularly it relates to circuits for dimming with pulse-width modulation (PWM).

Description of the Related Art

Active matrix LED display/backlight with mini- and micro-LED and OLED, equips a current driver to control the luminance of LED units in each pixel. The driver is serially connected to the LED between two voltage sources in order to control the current of the LED for luminance adjustment.

It is not stable for an LED unit to operate with a low current, and the chromaticity of an LED unit is current-dependent. Therefore, PWM (Pulse Width Modulation) with fixed optimum LED current, instead of current controlling, has been proposed as a solution to the issues stated above.

On the other hand, for some technical benefits, such as the stability that is characteristic of a TFT device, a lower-temperature process (the organic material of a flexible substrate may not be destroyed by the temperature), cost, etc., either PMOSs or NMOSs, instead of CMOSs, process can be utilized. Therefore, an LED driving circuit comprising either P-type transistors or N-type transistors is required.

SUMMARY

In an embodiment, an LED driving circuit for illuminating a first LED unit is provided. The LED driving circuit comprises: a data latch circuit, a current source, and a PWM circuit. The data latch circuit latches a data signal according to a first latch signal to generate a first control signal. The current source generates a constant current. The PWM circuit periodically passes the constant current through the first LED unit according to the first control signal and an enable signal.

A detailed description is given in the following embodiments with reference to the accompanying drawings.

BRIEF DESCRIPTION OF DRAWINGS

The disclosure can be more fully understood by reading the subsequent detailed description and examples with references made to the accompanying drawings, wherein.

DETAILED DESCRIPTION OF THE DISCLOSURE

Figure 1:
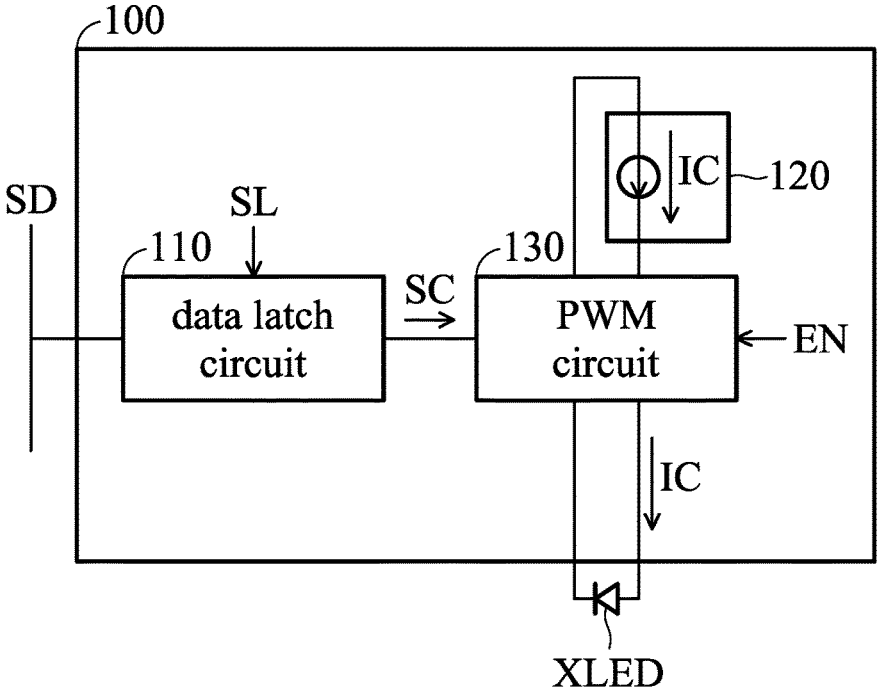
FIG. 1 is a block diagram of an LED driving circuit in accordance with an embodiment of the disclosure.

This description is made for the purpose of illustrating the general principles of the disclosure and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the disclosure is best determined by reference to the appended claims.

It is understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of an LED driving circuit in accordance with an embodiment of the disclosure. As shown in FIG. 1, the LED driving circuit 100 is configured to illuminate the LED unit XLED, which includes a data latch circuit 110, a current source 120, and a PWM circuit 130.

According to an embodiment of the disclosure, the LED driving circuit 100 may comprise a plurality of transistors implemented by P-type transistors. According to another embodiment of the disclosure, the LED driving circuit 100 may comprise a plurality of transistors implemented by N-type transistors. In other words, the LED driving circuit 100 may comprise a plurality of transistors implemented by either P-type transistors or N-type transistors.

The data latch circuit 110 latches the data signal SD according to a latch signal SL to generate the control signal SC. The current source 120 generates a constant current IC. The PWM circuit 130 periodically passes the constant current IC according to the control signal SC and the enable signal EN so that the constant current IC flows through the LED unit XLED. As shown in FIG. 1, whether the current source 120 sinks or sources the constant current IC is based on whether the LED driving circuit 100 is implemented by P-type transistors or N-type transistors.

Figure 2:
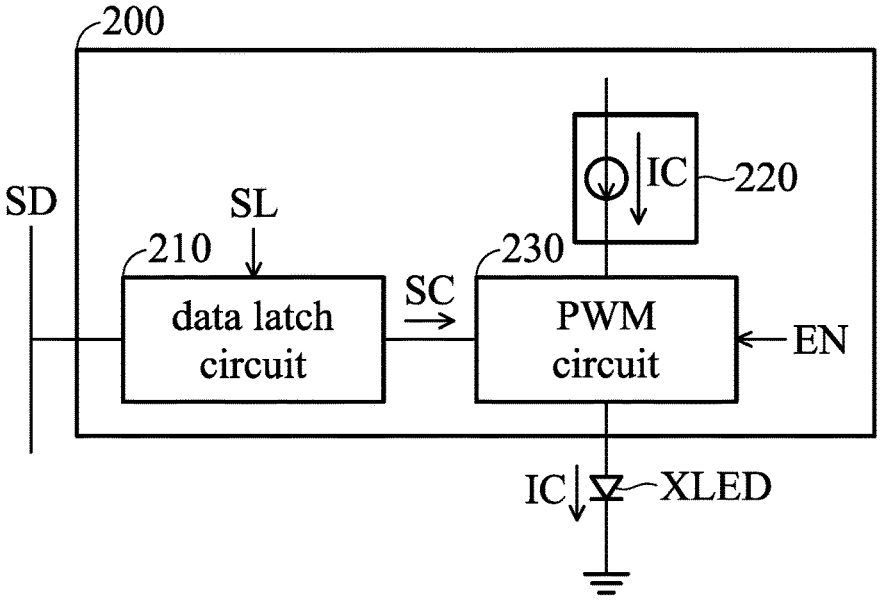
FIG. 2 is a block diagram of an LED driving circuit in accordance with an embodiment of the disclosure.

FIG. 2 is a block diagram of an LED driving circuit in accordance with an embodiment of the disclosure, in which the LED driving circuit in FIG. 2 comprises a plurality of transistors implemented by P-type transistors. As shown in FIG. 2, the LED driving circuit 200 includes a data latch circuit 210, a current source 220, and a PWM circuit 230, in which the data latch circuit 210, the current source 220, and the PWM circuit 230 correspond to the data latch circuit 110, the current source 120, and the PWM circuit 130 in FIG. 1. The LED driving circuit 200 couples the constant current IC to the LED unit XLED so that the constant current IC flows through the LED unit XLED to the ground.

Figure 3:
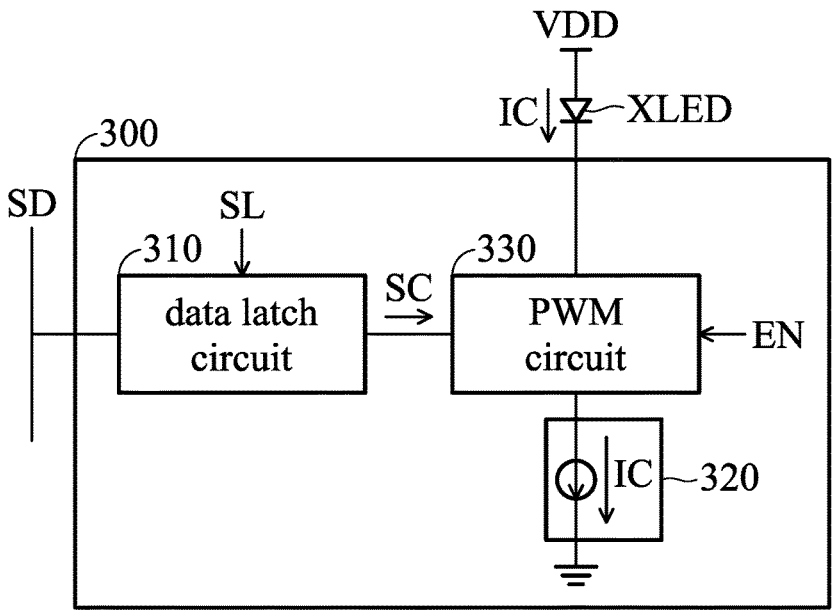
FIG. 3 is a block diagram of an LED driving circuit in accordance with an embodiment of the disclosure.

FIG. 3 is a block diagram of an LED driving circuit in accordance with another embodiment of the disclosure, in which the LED driving circuit in FIG. 3 comprises a plurality of transistors implemented by N-type transistors. As shown in FIG. 3, the LED driving circuit 300 includes a data latch circuit 310, a current source 320, and a PWM circuit 330, in which the data latch circuit 310, the current source 320, and the PWM circuit 330 correspond to the data latch circuit 110, the current source 120, and the PWM circuit 130 in FIG. 1. The LED driving circuit 300 couples the constant current IC to the LED unit XLED so that the constant current IC flows through the LED unit XLED from the supply voltage VDD.

According to an embodiment of the disclosure, the data signal SD, the control signal SC, and the enable signal EN are N bits, in which N is a positive integer. Thus, the data latch circuit 210 in FIG. 2, or the data latch circuit 310 in FIG. 3, comprises N latch units. Each of the latch units latches a corresponding bit of the data signal SD to generate a corresponding bit of the control signal SC.

Since N-type transistors and P-type transistors are complementary, one skilled in the art will understand how to modify the embodiments of the LED driving circuit with P-type transistors provided as follows to obtain the LED driving circuit with N-type transistors. In the following paragraphs, the LED driving circuit with P-type transistors are illustrated, but not intended to be limited to the embodiments with P-type transistors.

Figure 4:
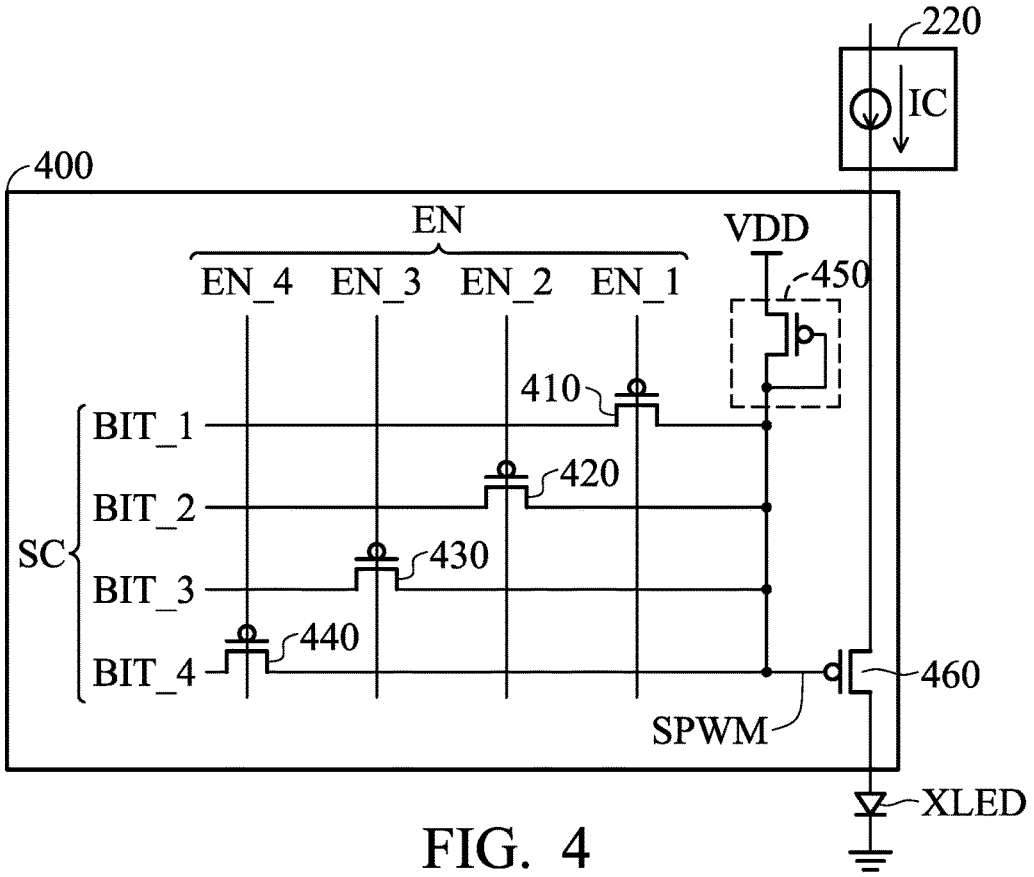
FIG. 4 is a block diagram of the PWM circuit 230 in FIG. 2 in accordance with an embodiment of the disclosure.

FIG. 4 is a block diagram of the PWM circuit 230 in FIG. 2 in accordance with an embodiment of the disclosure. As shown in FIG. 4, the PWM circuit 400 includes a first transmission transistor 410, a second transmission transistor 420, a third transmission transistor 430, a fourth transmission transistor 440, a pull-up transistor 450, and a dimming transistor 460.

According to an embodiment of the disclosure, the data signal SD, the control signal SC, and the enable signal EN are illustrated as 4-bit herein, but not intended to be limited thereto. The control signal SC includes a first bit BIT_1, a second bit BIT_2, a third bit BIT_3, and a fourth bit BIT_4, and the enable signal EN includes a first enable EN_1, a second enable EN_2, a third enable EN_3, and a fourth enable EN_4.

As shown in FIG. 4, the first transmission transistor 410, the second transmission transistor 420, the third transmission transistor 430, and the fourth transmission transistor 440 respectively pass the first bit BIT_1, the second bit BIT_2, the third bit BIT_3, and the fourth bit BIT_4 to a PWM signal SPWM according to the first enable EN_1, the second enable EN_2, the third enable EN_3, and the fourth enable EN_4. According to the embodiment shown in FIG. 4, the duty cycles of the first enable EN_1, the second enable EN_2, the third enable EN_3, and the fourth enable EN_4 are 50%, 25%, 12.5%, and 6.25% respectively.

The dimming transistor 460 is turned ON according to the PWM signal SPWM so that the constant current IC can flow through the LED unit XLED to illuminate the LED unit XLED. According to an embodiment of the disclosure, the pull-up transistor 450 pulls the PWM signal SPWM up to the supply voltage VDD to turn OFF the dimming transistor 460 when the first transmission transistor 410, the second transmission transistor 420, the third transmission transistor 430, and the fourth transmission transistor 440 are all turned OFF.

According to an embodiment of the disclosure, the LED unit XLED in FIG. 4 is normally OFF, and the first bit BIT_1, the second bit BIT_2, the third bit BIT_3, and the fourth bit BIT_4 are configured to turn ON the LED unit XLED. According to an embodiment of the disclosure, as illustrated in FIG. 4, the gate terminal of the pull-up transistor 450 is controlled by the PWM signal SPWM. Namely, the gate terminal of the pull-up transistor 450 is coupled to its drain terminal. According to other embodiments of the disclosure, the gate terminal of the pull-up transistor 450 may be controlled by another signal, such as the latch signal SL.

According to another embodiment of the disclosure, the PWM circuit 400 may include a first pull-up transistor and a second pull-up transistor (not shown in FIG. 4) which are controlled by a first latch signal SL1 and a second latch signal SL2, in which the first latch signal SL1 is configured to drive the LED unit XLED in FIG. 4, and the second latch signal SL2 is configured to drive another LED unit (not shown in FIG. 4). The first latch signal SL1 and the second latch signal SL2 will be described in the following paragraphs.

According to an embodiment of the disclosure, the first transmission transistor 410, the second transmission transistor 420, the third transmission transistor 430, or the fourth transmission transistor 440 is turned ON by the first enable EN_1, the second enable EN_2, the third enable EN_3, or the fourth enable EN_4 at the low voltage level. In other words, the first transmission transistor 410, the second transmission transistor 420, the third transmission transistor 430, and the fourth transmission transistor 440 are active low.

Figure 5:
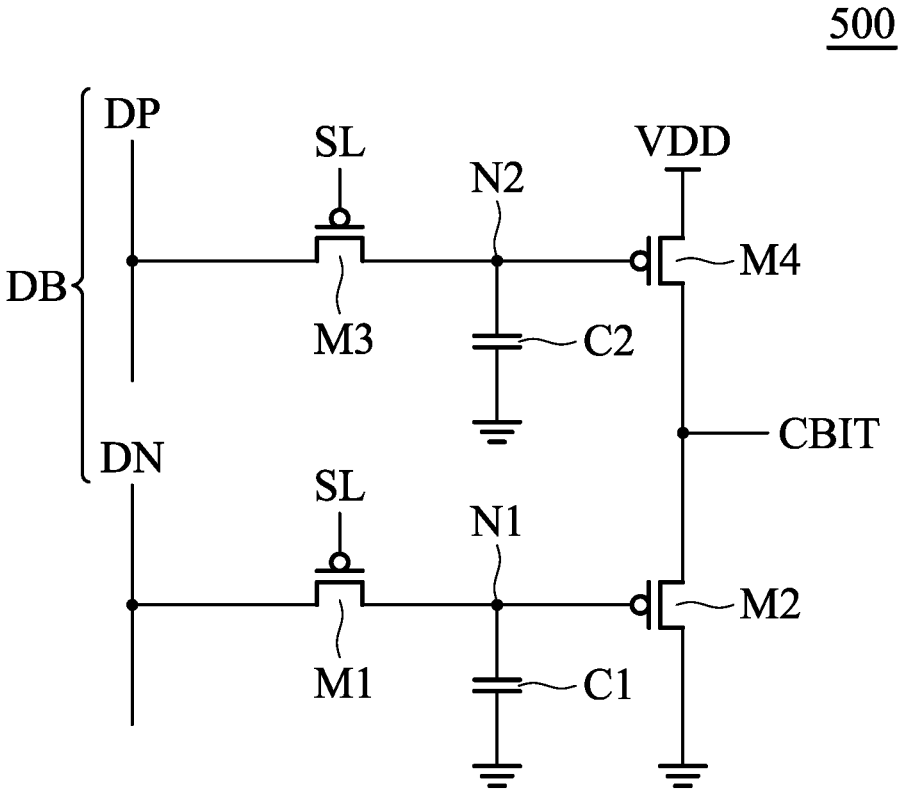
FIG. 5 is a block diagram of a latch unit in accordance with an embodiment of the disclosure.

FIG. 5 is a block diagram of a latch unit in accordance with an embodiment of the disclosure. Referring to FIG. 1, the data latch circuit 110 includes a plurality of latch units. According to an embodiment of the disclosure, the latch unit of the data latch circuit 110 is the latch unit 500 in FIG. 5. As shown in FIG. 5, the latch unit 500 generates a control bit CBIT which corresponds to any one of the first bit BIT_1, the second bit BIT_2, the third bit BIT_3, and the fourth bit BIT_4 of the control signal SC in FIG. 4 according to a corresponding data bit DB of the data signal SD.

As shown in FIG. 5, the latch unit 500 includes a first transistor M1, a first capacitor C1, a second transistor M2, a third transistor M3, a second capacitor C2, and a fourth transistor M4. According to an embodiment of the disclosure, the data signal SD includes a plurality of data bits DB, in which each data bit DB includes positive data DP and negative data DN, in which the negative data DN is an inverse of the positive data DP.

The first transistor M1 provides the negative data DN from a data bit DB of the data signal SD to a first node N1 according to the latch signal SL. The first capacitor C1, which is coupled between the first node N1 and the ground, stores the negative data DN. The second transistor M2 couples a control bit CBIT of the control signal SC to the ground according to the negative data DN stored in the first capacitor C1. According to an embodiment of the disclosure, the control bit CBIT in FIG. 5 may be any one of the first bit BIT_1, the second bit BIT_2, the third bit BIT_3, and the fourth bit BIT_4 of the control signal SC in FIG. 4.

According to an embodiment of the disclosure, the negative data DN ranges from a low voltage level to a high voltage level, in which the low voltage level should be less than the ground by the absolute value of the threshold voltage of the second transistor M2 so that the second transistor M2 can be completely turned ON when the negative data DN is at the low voltage level.

As shown in FIG. 5, the third transistor M3 provides the positive data DP from the data bit DB of the data signal SD to a second node N2 according to the latch signal SL. The second capacitor C2, which is coupled between the second node N2 and the ground, stores the positive data DP. The fourth transistor M4 provides the supply voltage VDD to the control bit CBIT of the control signal SC according to the positive data DP at the second node N2.

According to an embodiment of the disclosure, in order to implement the latch unit 500 with P-type transistors, the first capacitor C1 and the second capacitor C2 are required to form a pair of memory units, and the second transistor M2 and the fourth transistor M4 form a complementary push-pull driver to generate the control bit CBIT of the control signal SD.

Figure 6:
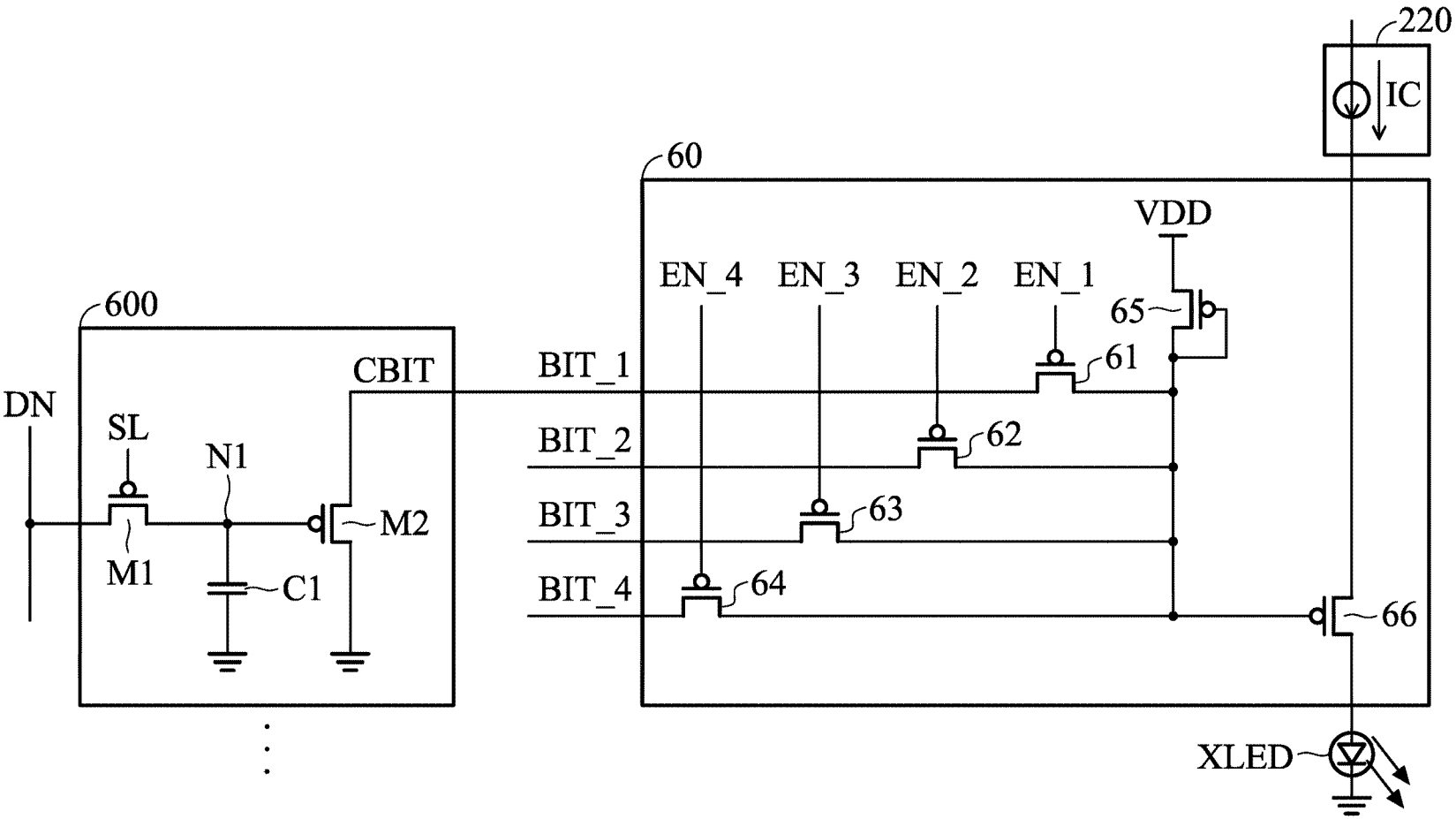
FIG. 6 is a block diagram of a latch unit in accordance with another embodiment of the disclosure.

FIG. 6 is a block diagram of a latch unit in accordance with another embodiment of the disclosure. As shown in FIG. 6, the latch unit 600 includes the first transistor M1, the first capacitor C1, the second transistor M2 of FIG. 5. According to an embodiment of the disclosure, a plurality of the latch units 600 are coupled to a corresponding one of the first bit BIT_1, the second bit BIT_2, the third bit BIT_3, and the fourth bit BIT_4 of the PWM circuit 60, and only one latch unit 600 is illustrated herein.

According to an embodiment of the disclosure, the PWM circuit 60 includes a first transmission transistor 61, a second transmission transistor 62, a third transmission transistor 63, a fourth transmission transistor 64, a pull-up transistor 65, and a dimming transistor 66, which corresponds to the PWM circuit 400.

According to an embodiment of the disclosure, since the second transistor M2 is configured to pull the control bit CBIT down to the ground to turn ON the dimming transistor 66, the pull-up transistor 65 is required to normally turn OFF the dimming transistor 66 when the first transmission transistor 61, the second transmission transistor 62, the third transmission transistor 63, and the fourth transmission transistor 64 are all OFF. According to an embodiment of the disclosure, the low voltage level of the negative data DN should be less than the ground level by an absolute value of the threshold voltage of the second transistor M2.

Figure 7:
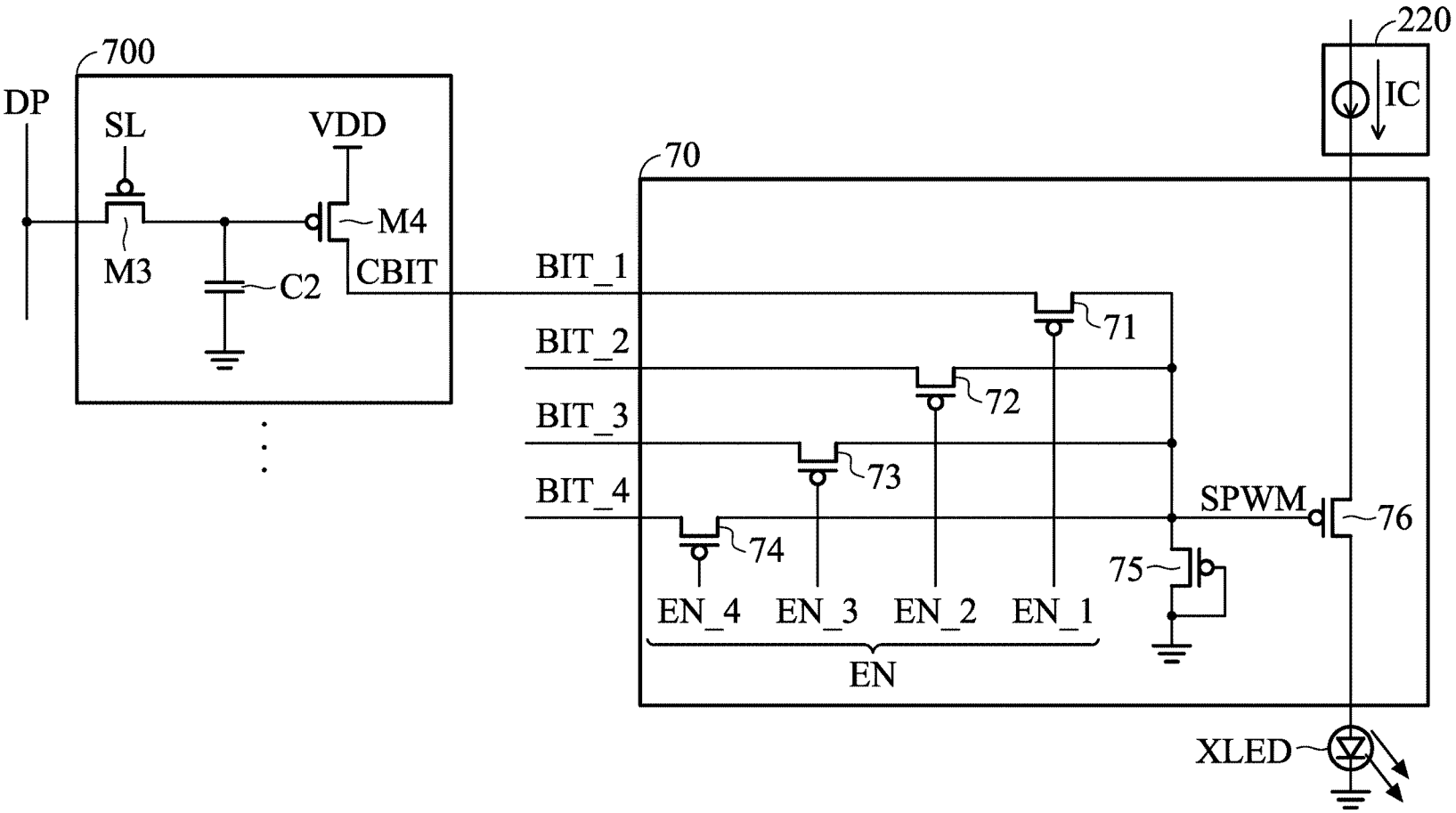
FIG. 7 is a block diagram of a latch unit in accordance with another embodiment of the disclosure.

FIG. 7 is a block diagram of a latch unit in accordance with another embodiment of the disclosure. As shown in FIG. 7, the latch unit 700 includes the third transistor M3, the second capacitor C2, and the fourth transistor M4. As shown in FIG. 7, a plurality of the latch units 700 are coupled to a corresponding one of the first bit BIT_1, the second bit BIT_2, the third bit BIT_3, and the fourth bit BIT_4 of the PWM circuit 70, and only one latch unit 700 is illustrated herein.

The PWM circuit 70 includes a first transmission transistor 71, a second transmission transistor 72, a third transmission transistor 73, a fourth transmission transistor 74, a pull-down transistor 75, and a dimming transistor 76, which corresponds to the PWM circuit 400 in FIG. 4.

According to an embodiment of the disclosure, since the fourth transistor M4 in FIG. 7 is configured to pull the control bit CBIT up to the supply voltage VDD, the pull-down transistor 75 is required to normally turn ON the dimming transistor 76 when the first transmission transistor 71, the second transmission transistor 72, the third transmission transistor 73, and the fourth transmission transistor 74 are all OFF. According to an embodiment of the disclosure, the first enable EN_1, the second enable EN_2, the third enable EN_3, and the fourth enable EN_4 in FIG. 7 are allowed to overlap since each of the first bit BIT_1, the second bit BIT_2, the third bit BIT_3, and the fourth bit BIT_4 is high impedance in the high logic level.

As shown in FIG. 7, the pull-down transistor 75 pulls the PWM signal SPWM down to the ground. According to an embodiment of the disclosure, as illustrated in FIG. 7, the gate terminal of the pull-down transistor 75 is tied to the ground. According to other embodiments of the disclosure, the gate terminal of the pull-down transistor 75 may be controlled by another signal, such as the latch signal SL.

According to an embodiment of the disclosure, since the fourth transistor M4 of the latch unit 700 is configured to pull the control bit CBIT up to the supply voltage VDD, the pull-down transistor 75 is configured to normally pull the PWM signal SPWM down to the ground level when the first transmission transistor 71, the second transmission transistor 72, the third transmission transistor 73, and the fourth transmission transistor 74 are all OFF.

According to an embodiment of the disclosure, it is allowable that the first enable EN_1, the second enable EN_2, the third enable EN_3, and the fourth enable EN_4 are overlapped since the control bit CBIT is in a high impedance state when the control bit CBIT is at the high voltage level.

Figure 8:
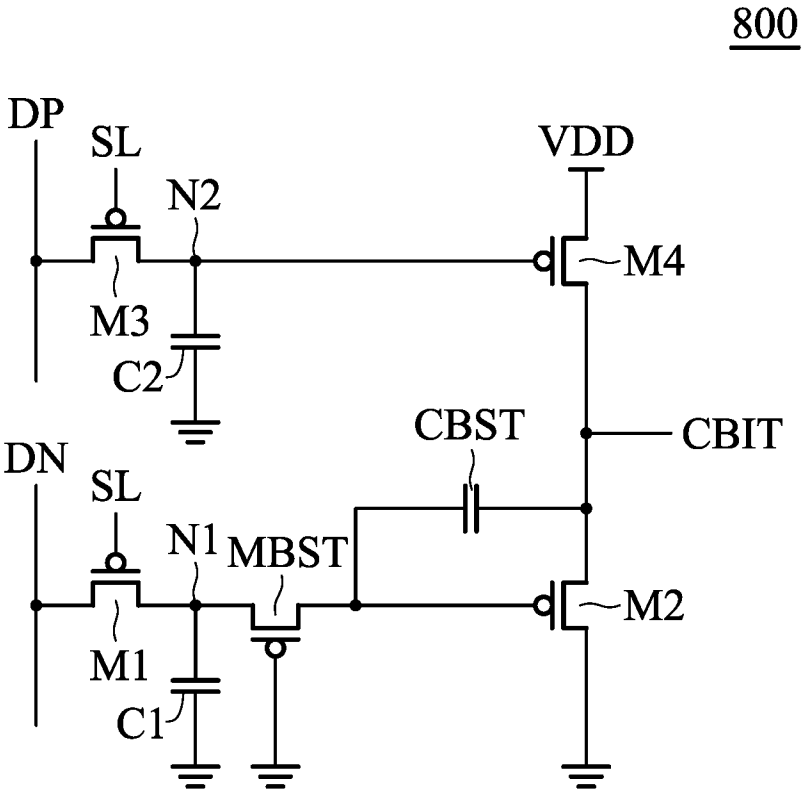
FIG. 8 is a block diagram of a latch unit in accordance with another embodiment of the disclosure.

FIG. 8 is a block diagram of a latch unit in accordance with another embodiment of the disclosure. Comparing the latch unit 800 in FIG. 8 to the latch unit 500 in FIG. 5, the latch unit 800 further includes a bootstrap transistor MBST and a bootstrap capacitor CBST.

As shown in FIG. 8, the bootstrap transistor MBST is coupled between the first node N1 and the gate terminal of the second transistor M2, and the gate terminal of the bootstrap transistor MBST is coupled to the ground. The bootstrap capacitor CBST is coupled between the control bit CBIT and the gate terminal of the second transistor M2.

According to an embodiment of the disclosure, the low voltage level of the negative data DN can be as low as the ground level of the latch unit 800.

According to an embodiment of the disclosure, the bootstrap transistor MBST and the bootstrap capacitor CBST are configured to completely turn ON the second transistor M2 so that the control bit CBIT can be pulled down to the ground. However, the effect of the bootstrap transistor MBST and the bootstrap capacitor CBST could be limited if the voltage difference between two terminals of the bootstrap capacitance CBST is small when the control bit CBIT is at the low voltage level before the latch signal SL turns ON the first transistor M1.

Figure 9:
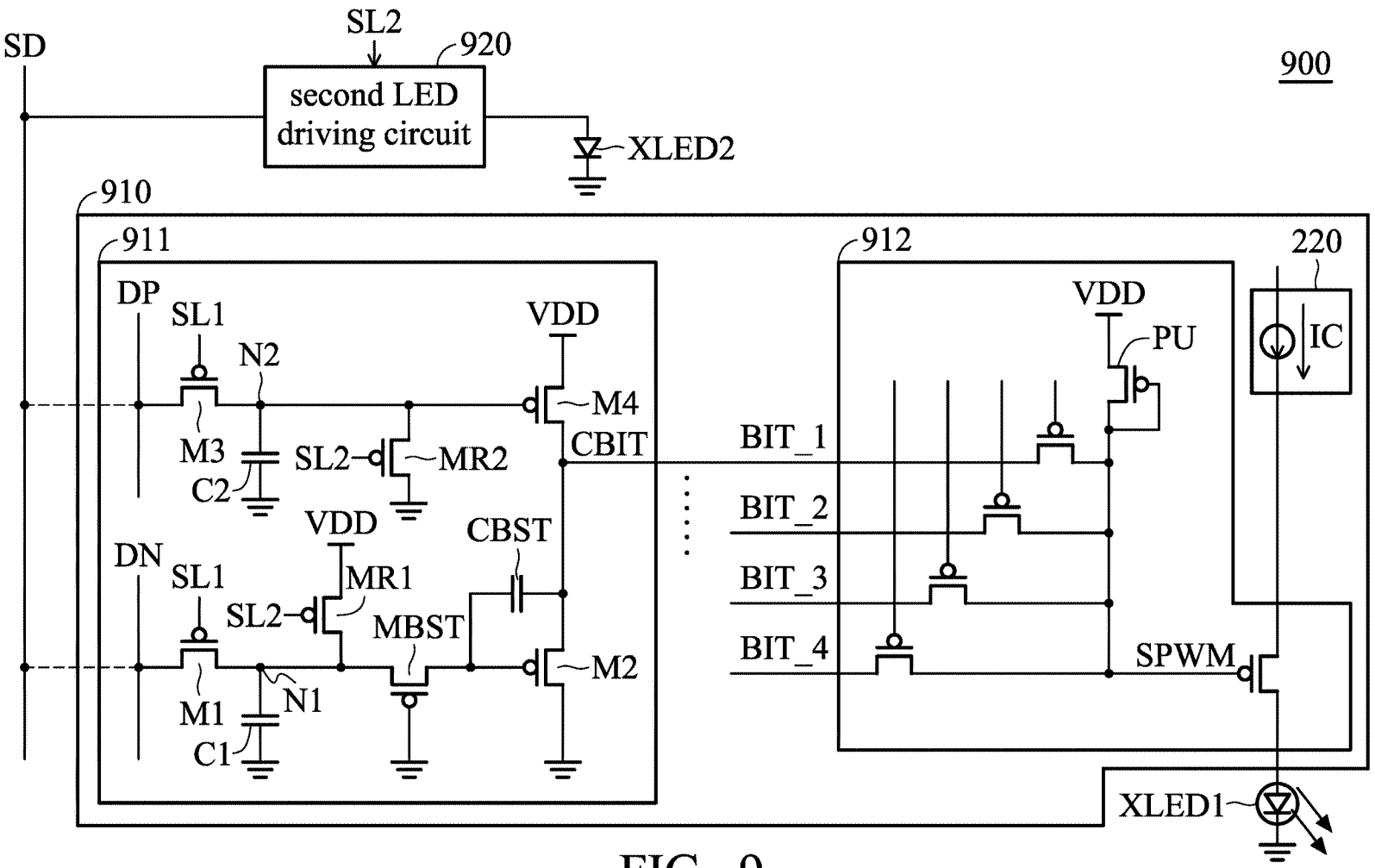
FIG. 9 is a block diagram of an LED driving array in accordance with another embodiment of the disclosure.

FIG. 9 is a block diagram of an LED driving array in accordance with another embodiment of the disclosure. As shown in FIG. 9, the LED driving array 900 includes a first LED driving circuit 910 and a second LED driving circuit 920. According to other embodiments of the disclosure, the LED driving array 900 may include a plurality of LED driving circuits. The LED driving array 900 including two LED driving circuits are illustrated herein, but not intended to be limited thereto.

The first LED driving circuit 910 is configured to illuminate the first LED unit XLED1 according to the data signal SD and the first latch signal SL1, and the second LED driving circuit 920 is configured to illuminate the second LED unit XLED2 according to the data signal SD and the second latch signal SL2.

According to an embodiment of the disclosure, the second LED unit XLED2 is illuminated prior to the first LED unit XLED1. In other words, the second latch signal SL2 is activated prior to the first latch signal SL1. According to an embodiment of the disclosure, the second LED unit XLED2 is placed near the first LED unit XLED1 and illuminated prior to the first LED unit XLED1. Thus, the second latch signal SL2 may be viewed as a latch signal prior to the first latch signal SL1.

As shown in FIG. 9, the first LED driving circuit 910 includes a plurality of latch units 911, each of which generates a corresponding bit of the control signal SC (i.e., the control bit CBIT) to the PWM circuit 912. According to an embodiment of the disclosure, the PWM circuit 912 corresponds to the PWM circuit 400 in FIG. 4, which is not repeated herein.

As shown in FIG. 9, the PWM circuit includes a pull-up transistor PU. According to an embodiment of the disclosure, the pull-up transistor PU is controlled by the PWM signal SPWM. Namely, the gate terminal of the pull-up transistor PU is coupled to its drain terminal. According to another embodiment of the disclosure, the gate terminal of the pull-up transistor PU is controlled by the first latch signal SL1. According to another embodiment of the disclosure, the gate terminal of the pull-up transistor PU is controlled by the second latch signal SL2.

Comparing the latch unit 911 in FIG. 9 to the latch unit 800 in FIG. 8, the latch unit 911 further includes a first preset transistor MR1 and a second preset transistor MR2. The first preset transistor MR1 is configured to provide the supply voltage VDD to the first node N1 according to the second latch signal SL2. The second present transistor MR2 is configured to provide the ground to the second node N2 according to the second latch signal SL2.

According to an embodiment of the disclosure, the second LED unit XLED2 is turned ON prior to the first LED unit XLED1. When the second LED unit XLED2 is turned ON according to the second latch signal SL2, the second latch signal SL2 is also configured to turn ON the first preset transistor MR1 and the second preset transistor MR2 of the latch unit 911 in the first LED driving circuit 910 to preset the voltages of the control bit CBIT and the first node N1.

According to an embodiment of the disclosure, when the first preset transistor MR1 and the second preset transistor MR2 are turned ON, the voltage of the first node N1 is pulled up to the supply voltage VDD, and the voltage of the second node N2 is pull down to the ground level. Thus, the second transistor M2 is turned OFF and the fourth transistor M4 is turned ON so that the control bit CBIT is pulled up to the supply voltage VDD. In other words, the voltages of both terminals of the bootstrap capacitor CBST are preset to the supply voltage VDD by the second latch signal SL2.

According to an embodiment of the disclosure, when the bootstrap capacitor CBST is preset and the negative data DN at the low voltage level, which is the ground level, is sampled by the first latch signal SL1, the voltage of the gate terminal of the second transistor M2 is equal to an absolute value of the threshold voltage of the bootstrap transistor MBST since the bootstrap transistor MBST is turned OFF.

Since the voltage of the control bit CBIT is pulled down from the supply voltage VDD, the voltage of the gate terminal of the second transistor M2 can be further pulled down due to the voltage drop on the control bit CBIT coupled by the bootstrap capacitor CBST. Therefore, the voltage of the gate terminal of the second transistor M2 can be lower than zero volts to completely turn ON the second transistor M2. In addition, the bootstrap transistor MBST is configured to separate the first node N1 and the gate terminal of the second transistor M2 so that the gate terminal of the second transistor M2 can be better pulled down to a voltage lower than zero by AC coupling through the bootstrap capacitor CBST.

As shown in FIG. 9, the PWM circuit includes a pull-up transistor PU. According to an embodiment of the disclosure, the pull-up transistor PU is controlled by the PWM signal SPWM. Namely, the gate terminal of the pull-up transistor PU is coupled to its drain terminal. According to another embodiment of the disclosure, the gate terminal of the pull-up transistor PU is controlled by the first latch signal SL1 (not shown in FIG. 9). According to another embodiment of the disclosure, the gate terminal of the pull-up transistor PU is controlled by the second latch signal SL2 (not shown in FIG. 9).

Figure 10:
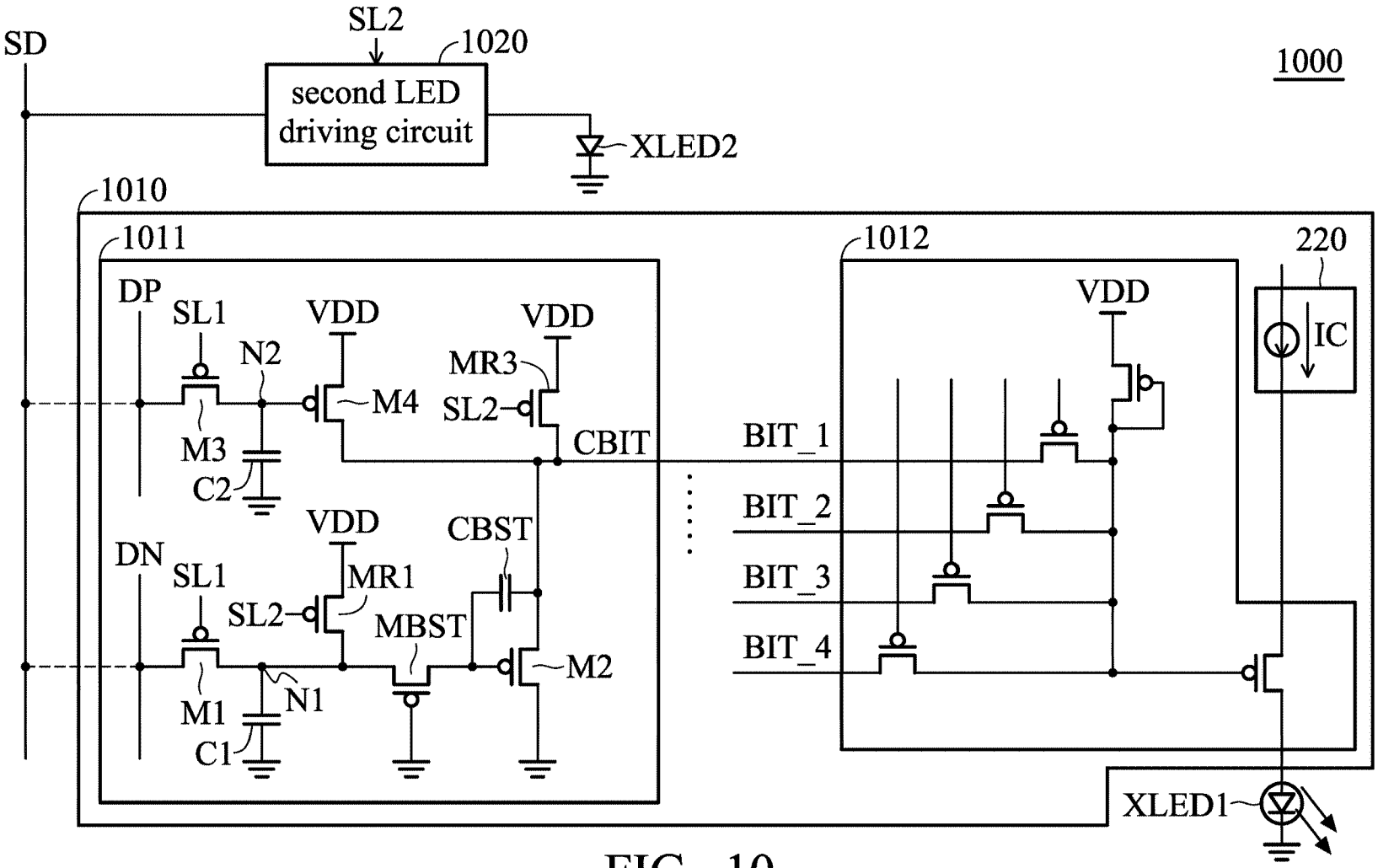
FIG. 10 is a block diagram of an LED driving array in accordance with another embodiment of the disclosure.

FIG. 10 is a block diagram of an LED driving array in accordance with another embodiment of the disclosure. As shown in FIG. 10, the LED driving array 1000 includes a first LED driving circuit 1010 and a second LED driving circuit 1020. According to other embodiments of the disclosure, the LED driving array 1000 may include a plurality of LED driving circuits. The LED driving array 1000 including two LED driving circuits are illustrated herein, but not intended to be limited thereto.

The first LED driving circuit 1010 is configured to illuminate the first LED unit XLED1 according to the data signal SD and the first latch signal SL1, and the second LED driving circuit 1020 is configured to illuminate the second LED unit XLED2 according to the data signal SD and the second latch signal SL2. According to an embodiment of the disclosure, the second LED unit XLED2 is illuminated prior to the first LED unit XLED1.

Comparing the first LED driving circuit 1010 to the first LED driving circuit 910 in FIG. 9, the second preset transistor MR2 of the latch unit 911 in FIG. 9 is replaced by a third preset transistor MR3 in the latch unit 1011 in FIG. 10 and the PWM circuit 1020 corresponds to the PWM circuit 400 in FIG. 4.

The third preset transistor MR3 provides the supply voltage VDD to the control bit CBIT in response to the second latch signal SL2, in which the second latch signal SL2 is configured to illuminate the second LED unit XLED2 which is illuminated prior to the first LED unit XLED1.

Since the control bit CBIT and the voltage of the gate terminal of the second transistor M2 are preset to the supply voltage VDD, the voltages of both terminals of the bootstrap capacitor CBST are preset to the supply voltage VDD. When the negative data DN at the low voltage level, which is the ground level, is sampled to the first node N1 by the first latch signal SL1, the second transistor M2 is turned ON so that the voltage of the control bit CBIT is pulled down from the supply voltage VDD. During the voltage drop of the control bit CBIT, the voltage drop is coupled to the gate terminal of the second transistor M2 through the bootstrap capacitor CBST so that the gate terminal of the second transistor M2 is further pulled down to a voltage lower than zero to completely turn ON the second transistor M2.

Figure 11:
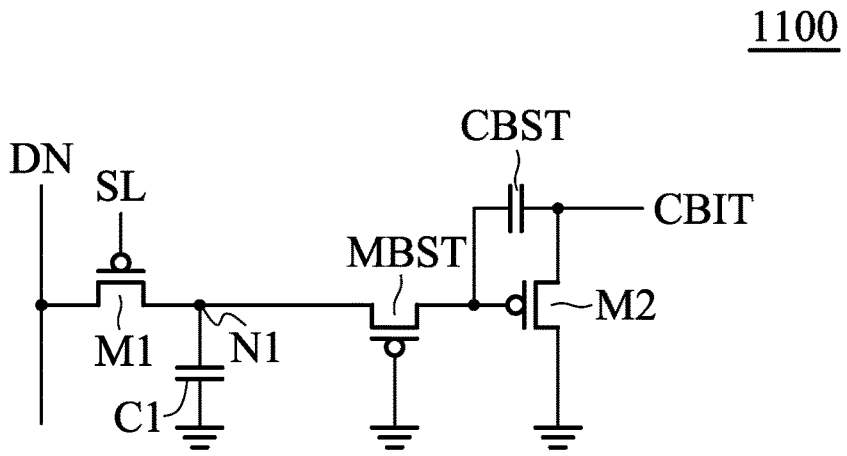
FIG. 11 is a block diagram of a latch unit in accordance with another embodiment of the disclosure.

FIG. 11 is a block diagram of a latch unit in accordance with another embodiment of the disclosure. Comparing the latch unit 1100 to the latch unit 800 in FIG. 8, the latch unit 1100 includes the first transistor M1, the first capacitor C1, the second transistor M2, the bootstrap transistor MBST, and the bootstrap capacitor CBST, and the third transistor M3, the second capacitor C2, and the fourth transistor M4 are omitted.

According to an embodiment of the disclosure, the low voltage level of the negative data DN can be as low as the ground level of the latch unit 1100. According to an embodiment of the disclosure, since the third transistor M3, the second capacitor C2, and the fourth transistor M4 of the latch unit 800 are omitted, the area of the latch unit 1100 can be reduced so that the cost can be reduced as well.

According to an embodiment of the disclosure, the low voltage level of the negative data DN can be as low as the ground with the aid of the bootstrap capacitor CBST and the bootstrap transistor MBST.

Figure 12:
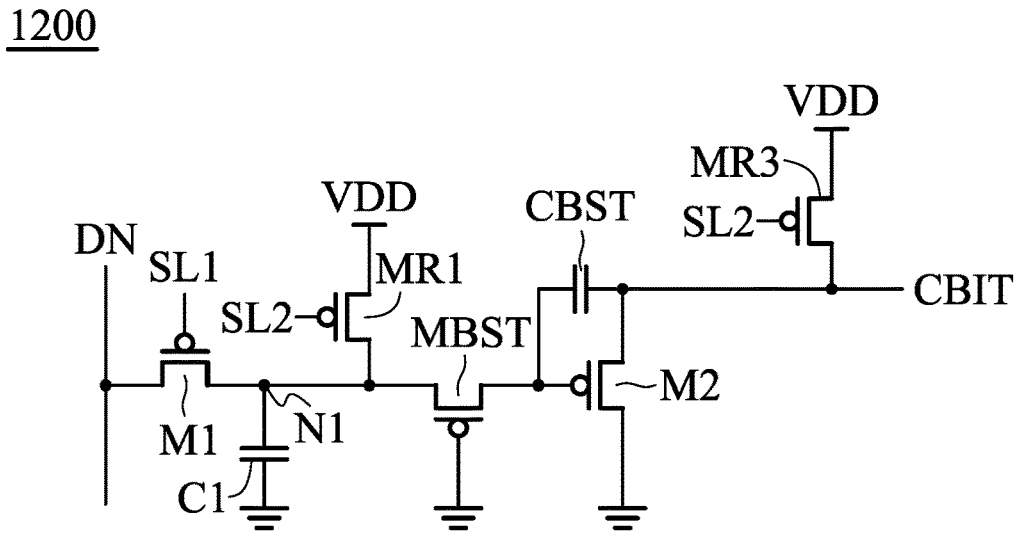
FIG. 12 is a block diagram of a latch unit in accordance with another embodiment of the disclosure.

FIG. 12 is a block diagram of a latch unit in accordance with another embodiment of the disclosure. Comparing the latch unit 1200 to the latch unit 1011 in FIG. 10, the latch unit 1200 includes the first transistor M1, the first capacitor C1, the second transistor M2, the bootstrap transistor MBST, the bootstrap capacitor CBST, the first preset transistor MR1, and the third preset transistor MR3, and the third transistor M3, the second capacitor C2, and the fourth transistor M4 are omitted.

According to an embodiment of the disclosure, the low voltage level of the negative data DN can be as low as the ground level of the latch unit 1200. According to an embodiment of the disclosure, since the third transistor M3, the second capacitor C2, and the fourth transistor M4 of the latch unit 1011 are omitted, the area of the latch unit 1200 can be reduced so that the cost can be reduced as well.

Figure 13:
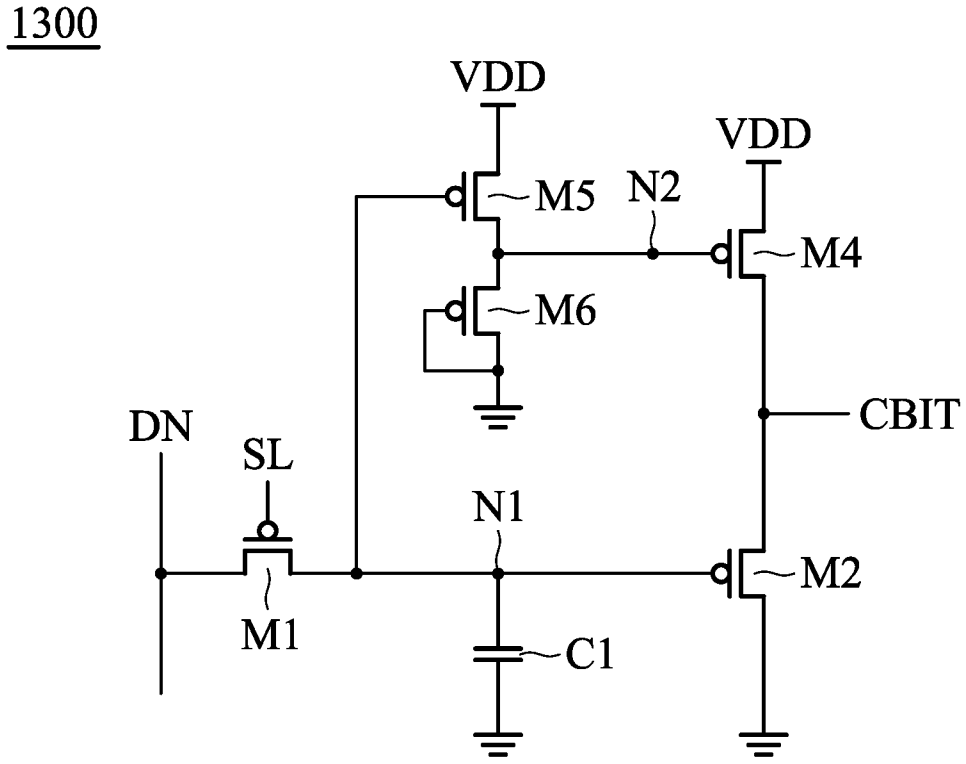
FIG. 13 is a block diagram of a latch unit in accordance with another embodiment of the disclosure.

FIG. 13 is a block diagram of a latch unit in accordance with another embodiment of the disclosure. Comparing the latch unit 1300 to the latch unit 500 in FIG. 5, the third transistor M3 and the second capacitor C2 are replaced by a fifth transistor M5 and a sixth transistor M6.

According to an embodiment of the disclosure, the fifth transistor M5 and the sixth transistor M6 are configured to act as an inverter to invert the negative data DN. Thus, the positive data DP and the second capacitor C2 shown in FIGS. 5, 8, and 9 are no longer required. According to an embodiment of the disclosure, the gate terminal of the sixth transistor M6 is coupled to the ground. According to other embodiments of the disclosure, the gate terminal of the sixth transistor M6 could be controlled by other signals.

According to an embodiment of the disclosure, by incorporating the fifth transistor M5 and the sixth transistor M6, the positive data DP can be reduced so that the I/O interface of the data signal SD can be reduced as well. According to an embodiment of the disclosure, the low voltage level of the negative data DN should be less than the ground level by an absolute value of the threshold voltage of the second transistor M2 to completely turn ON the second transistor M2.

Figure 14:
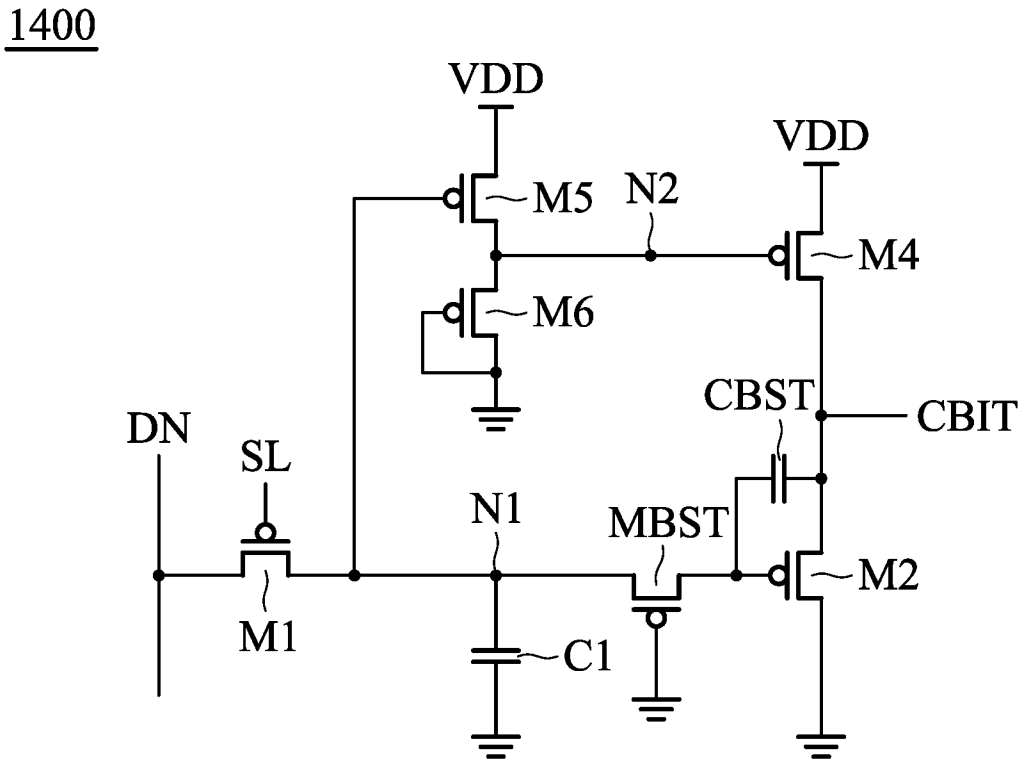
FIG. 14 is a block diagram of a latch unit in accordance with another embodiment of the disclosure.

FIG. 14 is a block diagram of a latch unit in accordance with another embodiment of the disclosure. Comparing the latch unit 1400 to the latch unit 1300 in FIG. 13, the latch unit 1400 further includes the bootstrap capacitor CBST and the bootstrap transistor MBST.

According to an embodiment of the disclosure, the low voltage level of the negative data DN in FIG. 14 could be equal to the ground level due to the bootstrap capacitor CBST and the bootstrap transistor MBST. The effect of the bootstrap capacitor CBST and the bootstrap transistor MBST is stated above, which is not repeated herein.

Figure 15:
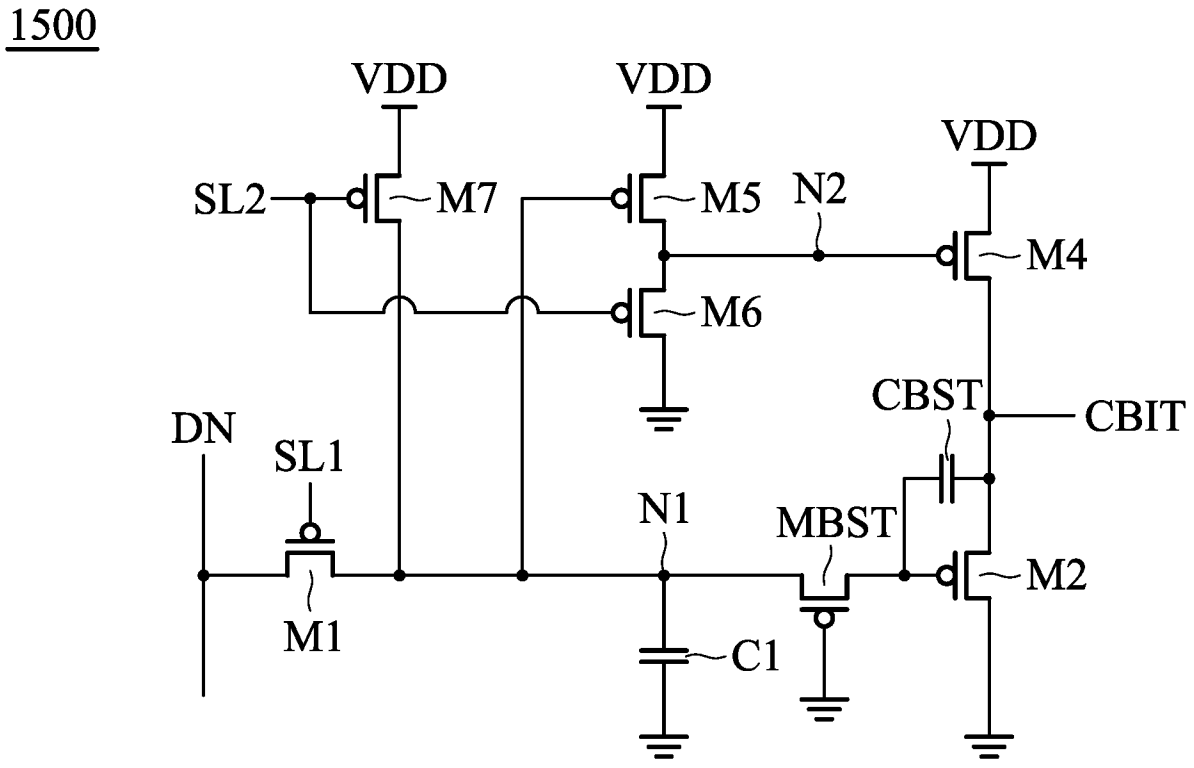
FIG. 15 is a block diagram of a latch unit in accordance with another embodiment of the disclosure.

FIG. 15 is a block diagram of a latch unit in accordance with another embodiment of the disclosure. As shown in FIG. 15, the gate terminal of the sixth transistor M6 is controlled by the second latch signal SL2, and the gate terminal of the first transistor M1 is controlled by the first latch signal SL1. As stated in FIGS. 9-10, the first latch signal SL1 is configured to drive the first LED unit XLED1, and the second latch signal SL2 is configured to drive the second LED unit XLED2, in which the second LED unit XLED2 is illuminated prior to the first LED unit XLED1.

Comparing the latch unit 1500 to the latch unit 1400 in FIG. 14, the latch unit 1500 further includes a seventh transistor M7. As shown in FIG. 15, the seventh transistor M7 provides the supply voltage VDD to the first node N1 according to the second latch signal SL2. Since the second LED unit XLED2 is illuminated prior to the first LED unit XLED1, the second latch signal SL2 is also prior to the first latch signal SL1.

Thus, before the first latch signal SL1 activates the first transistor M1, the second latch signal SL2 turns ON the sixth transistor M6 and the seventh transistor M7 so that the first node N1 is coupled to the supply voltage VDD and the second node N2 is coupled to the ground. In other words, the effect of the first preset transistor MR1 and the second preset transistor MR2 in FIG. 9 and that of the first preset transistor MR1 and the third transistor MR3 in FIG. 10 can be achieved by the seventh transistor M7.

As shown in FIGS. 5-15, the latch unit comprises a plurality of transistors implemented by P-type transistors. However, the plurality of transistors may be implemented by N-type transistors as well.

Figure 16:
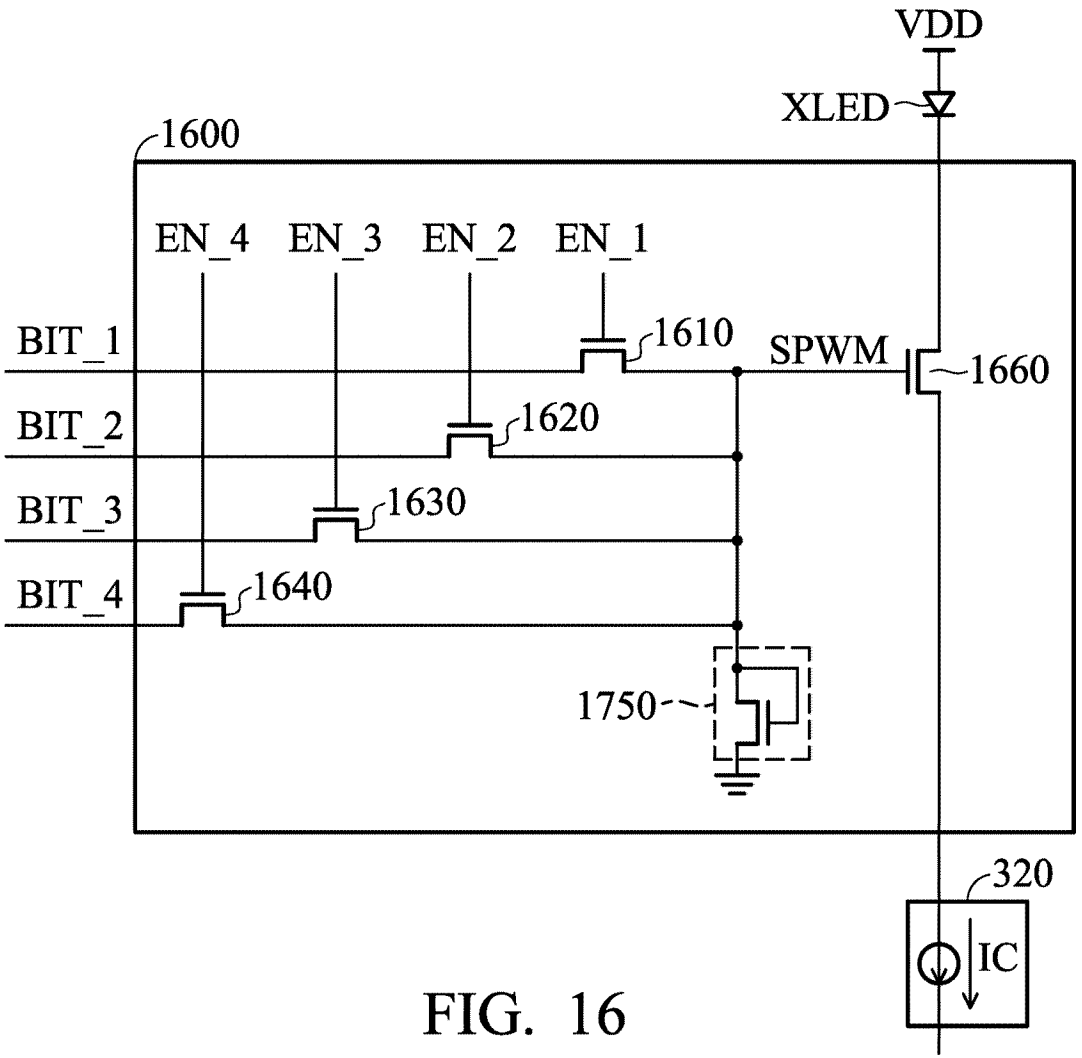
FIG. 16 is a block diagram of the PWM circuit in FIG. 3 in accordance with an embodiment of the disclosure.

FIG. 16 is a block diagram of the PWM circuit in FIG. 3 in accordance with an embodiment of the disclosure. According to an embodiment of the disclosure, the PWM circuit 1600 comprises a plurality of transistors implemented by N-type transistors. As shown in FIG. 16, the PWM circuit 1600 includes a first transmission transistor 1610, a second transmission transistor 1620, a third transmission transistor 1630, a fourth transmission transistor 1640, a pull-down transistor 1650, and a dimming transistor 1660.

The first transmission transistor 1610, the second transmission transistor 1620, the third transmission transistor 1630, the fourth transmission transistor 1640, and the dimming transistor 1660 correspond to the first transmission transistor 410, the second transmission transistor 420, the third transmission transistor 430, the fourth transmission transistor 440, and the dimming transistor 460 respectively, except for being N-type transistors.

The pull-down transistor 1750 is configured to pull the PWM signal SPWM down to the ground level. According to the embodiment shown in FIG. 16, the gate terminal of the pull-down transistor 1750 is controlled by the PWM signal SPWM. In other words, the pull-down transistor 1750 is gate-to-drain connected.

According to other embodiments of the disclosure, the pull-down transistor 1750 may be controlled by other signals, such as the latch signal SL. According to another embodiment of the disclosure, the PWM circuit 1600 includes a first pull-down transistor and a second pull-down transistor (not shown in FIG. 16) which are controlled by the first latch signal SL1 and the second latch signal SL2 respectively.

According to other embodiments of the disclosure, the pull-down transistor 1750 can be replaced by a pull-up transistor. The pull-up transistor 1750 is configured to pull the PWM signal SPWM up to the supply voltage VDD.

Figure 17:
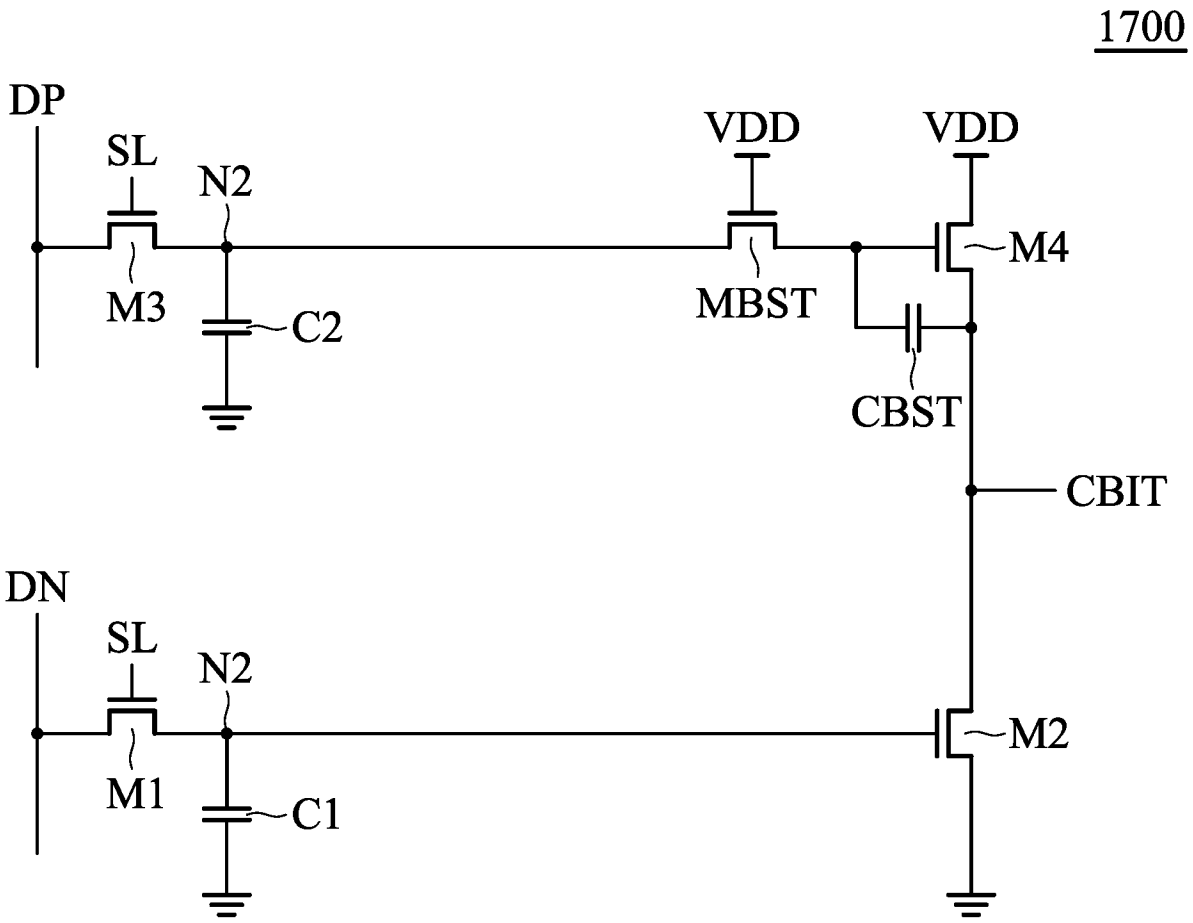
FIG. 17 is a block diagram of a latch unit in accordance with another embodiment of the disclosure.

FIG. 17 is a block diagram of a latch unit in accordance with another embodiment of the disclosure, in which the latch unit comprises a plurality of transistors implemented by N-type transistors. Comparing the latch unit 1700 to the latch unit 800 in FIG. 8, all the P-type transistors in the latch unit 800 are converted into N-type transistors with some required modifications to be the latch unit 1700.

The bootstrap transistor MBST in FIG. 17 is coupled between the second node N2 and the gate terminal of the fourth transistor M4, and the gate terminal of the bootstrap transistor MBST is coupled to the supply voltage VDD. The bootstrap capacitor CBST in FIG. 17 is coupled between the gate terminal of the fourth transistor M4 and the control bit CBIT.

Figure 18:
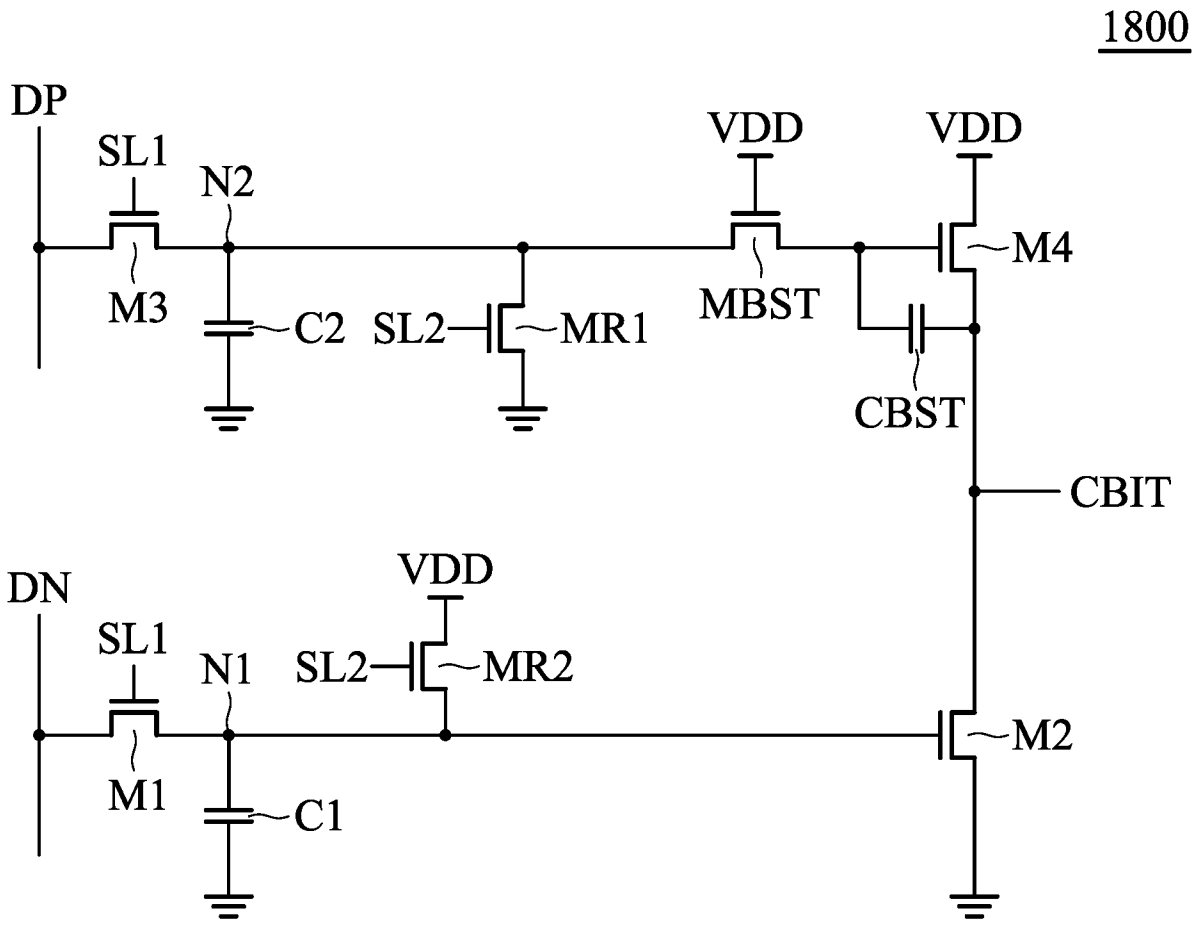
FIG. 18 is a block diagram of an LED driving array in accordance with another embodiment of the disclosure.

FIG. 18 is a block diagram of a latch unit in accordance with another embodiment of the disclosure, in which the latch unit comprises a plurality of transistors implemented by N-type transistors. Comparing the latch unit 1800 to the latch unit 911, all the P-type transistors in the latch unit 911 are converted into N-type transistors to be the latch unit 1800. Comparing the latch unit 1800 to the latch unit 1700, the latch unit 1800 further includes the first preset transistor MR1 and the second preset transistor MR2.

As shown in FIG. 18, the first preset transistor MR1 couples the second node N2 to the ground according to the second latch signal SL2. The second preset transistor MR2 provides the supply voltage VDD to the first node N1 according to the second latch signal SL2. Therefore, the voltages of both terminals of the bootstrap capacitor CBST can be preset to the ground.

Figure 19:
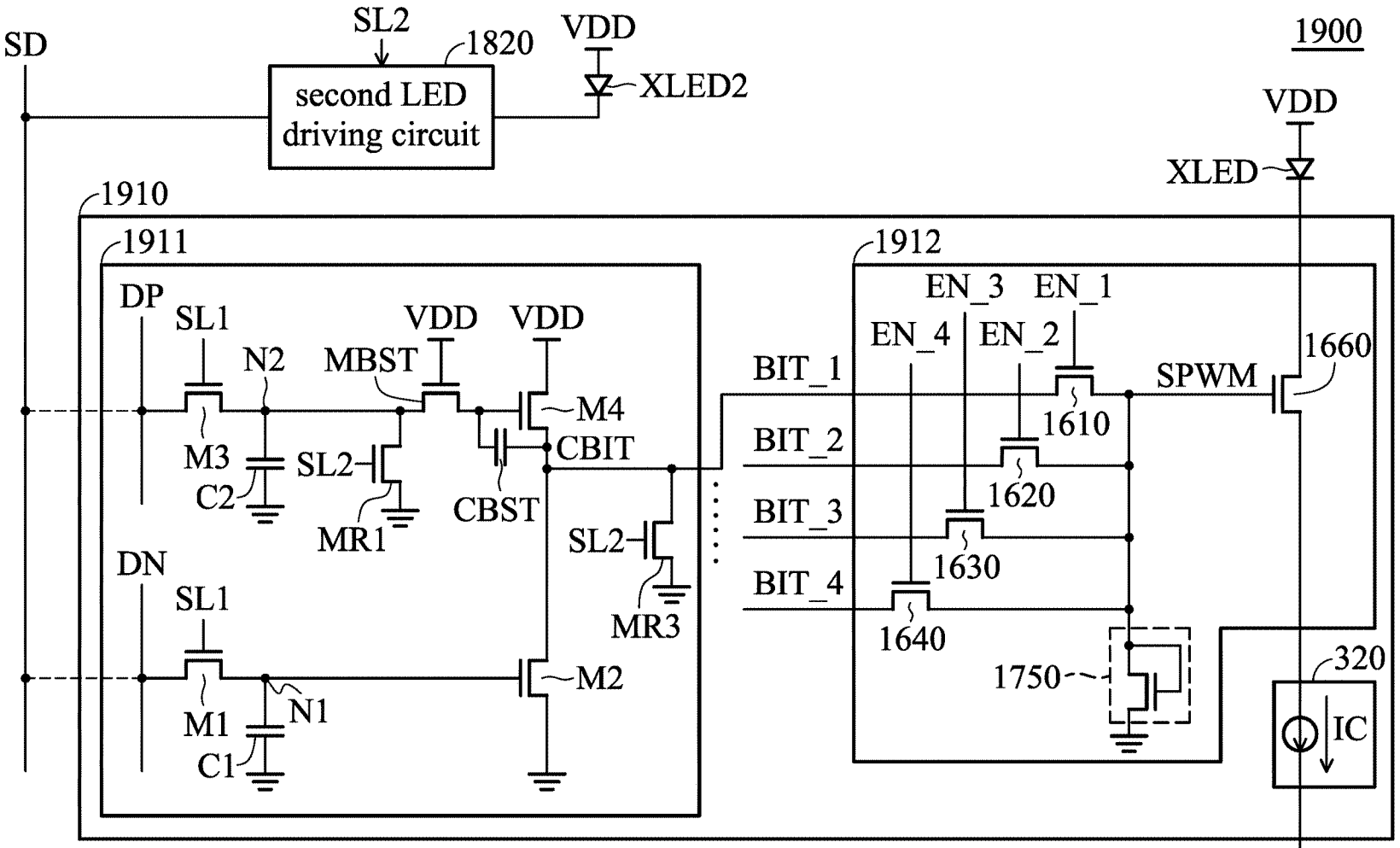
FIG. 19 is a block diagram of an LED driving array in accordance with another embodiment of the disclosure.

FIG. 19 is a block diagram of an LED driving array in accordance with another embodiment of the disclosure. As shown in FIG. 19, the LED driving array 1900 includes a first LED driving circuit 1910 and a second LED driving circuit 1920. According to other embodiments of the disclosure, the LED driving array 1900 may include a plurality of LED driving circuits. The LED driving array 1900 including two LED driving circuits are illustrated herein, but not intended to be limited thereto.

The first LED driving circuit 1910 is configured to illuminate the first LED unit XLED1 according to the data signal SD and the first latch signal SL1, and the second LED driving circuit 1920 is configured to illuminate the second LED unit XLED2 according to the data signal SD and the second latch signal SL2. According to an embodiment of the disclosure, the second LED unit XLED2 is illuminated prior to the first LED unit XLED1.

The first LED driving circuit 1910 includes a plurality of latch units 1911, each of which generates a corresponding bit of the control signal SC (i.e., the control bit CBIT) to the PWM circuit 1912. According to an embodiment of the disclosure, the PWM circuit 1912 corresponds to the PWM circuit 1600 in FIG. 16, which is not repeated herein.

Comparing the latch unit 1911 to the latch unit 1800 in FIG. 18, the second preset transistor MR2 of the latch unit 1800 in FIG. 18 is replaced by a third preset transistor MR3 in the latch unit 1911 in FIG. 19. The third preset transistor MR3 couples the control bit CBIT to the ground in response to the second latch signal SL2, in which the second latch signal SL2 is configured to illuminate the second LED unit XLED2 which is illuminated prior to the first LED unit XLED1.

Since the control bit CBIT and the voltage of the gate terminal of the fourth transistor M4 are preset to the supply voltage VDD, the voltages of both terminals of the bootstrap capacitor CBST are preset to the ground. When the positive data DP at the high voltage level, which is the supply voltage VDD, is sampled to the second node N2 by the first latch signal SL1, the fourth transistor M4 is turned ON so that the voltage of the control bit CBIT is pulled up from the ground. During the voltage rise of the control bit CBIT, the voltage rise is coupled to the gate terminal of the fourth transistor M4 through the bootstrap capacitor CBST so that the gate terminal of the fourth transistor M4 is further pulled up to a voltage exceeding zero to completely turn ON the fourth transistor M4.

Figure 20:
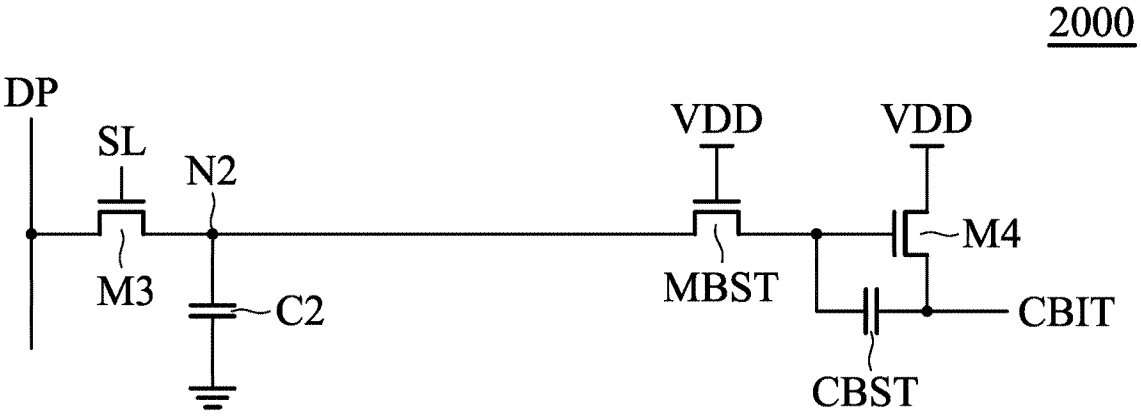
FIG. 20 is a block diagram of a latch unit in accordance with another embodiment of the disclosure.

FIG. 20 is a block diagram of a latch unit in accordance with another embodiment of the disclosure. Comparing the latch unit 2000 to the latch unit 1700 in FIG. 17, the latch unit 2000 includes the bootstrap capacitor CBST, and the third transistor M3, the second capacitor C2, the fourth transistor M4, the bootstrap transistor MBST, and the first transistor M1, the first capacitor C1, the second transistor M2 are omitted.

Comparing the latch unit 2000 to the latch unit 1100 in FIG. 11, all the P-type transistors have been converted into N-type transistors with some required modifications to be the latch unit 2000.

Figure 21:
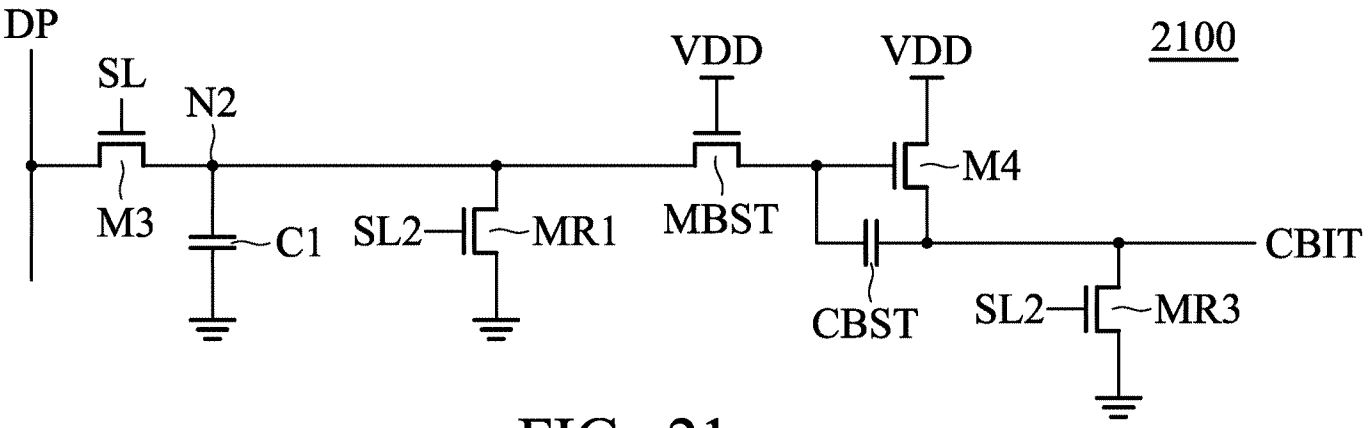
FIG. 21 is a block diagram of a latch unit in accordance with another embodiment of the disclosure.

FIG. 21 is a block diagram of a latch unit in accordance with another embodiment of the disclosure. Comparing the latch unit 2100 to the latch unit 1911, the third preset transistor MR3, and the third transistor M3, the second capacitor C2, and the fourth transistor M4 of the latch unit 1911 are omitted. Comparing the latch unit 2100 to the latch unit 1200, all the P-type transistors of the latch unit 1200 have been converted into N-type transistors with some required modifications to be the latch unit 2100.

Figure 22:
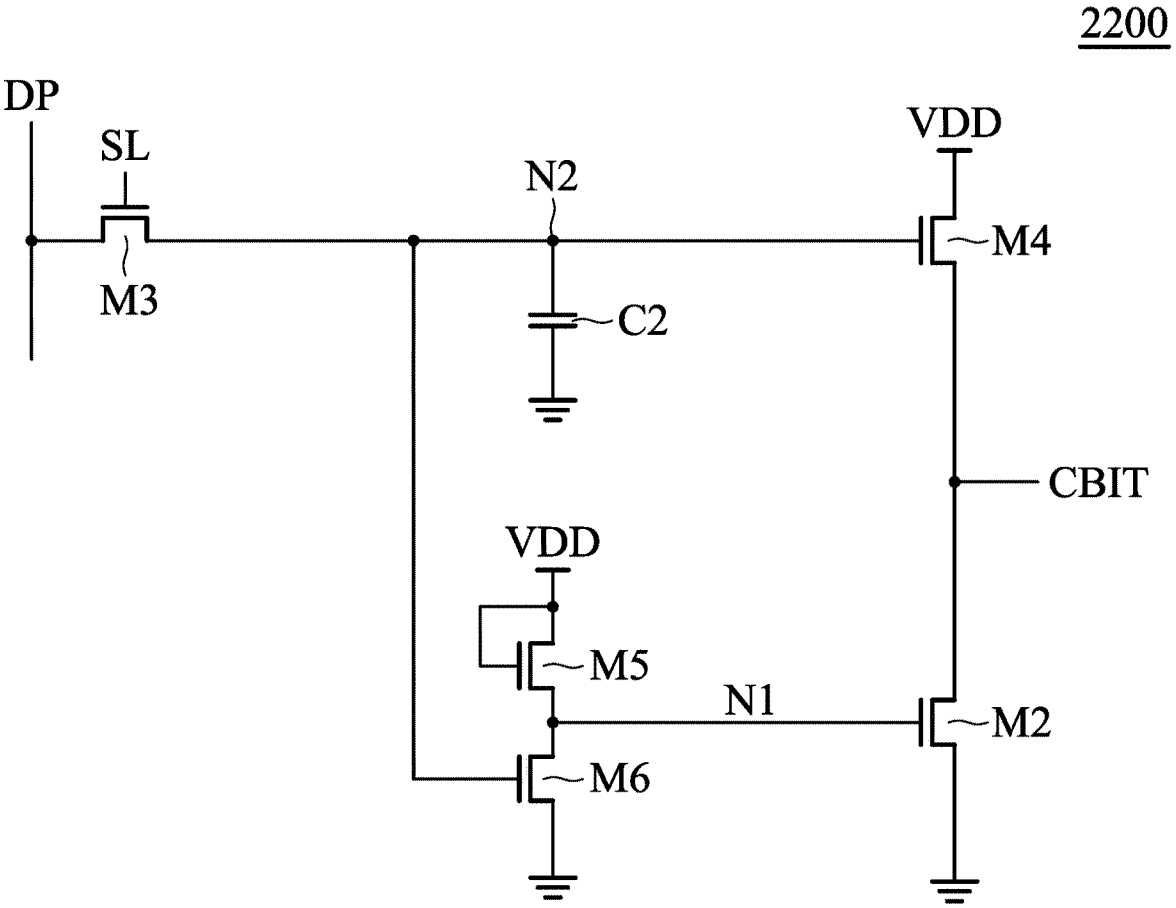
FIG. 22 is a block diagram of a latch unit in accordance with another embodiment of the disclosure.

FIG. 22 is a block diagram of a latch unit in accordance with another embodiment of the disclosure. Comparing the latch unit 2200 to the latch unit 1300 in FIG. 13, all the P-type transistors of the latch unit 1300 have been converted into N-type transistors with some required modifications to be the latch unit 2200.

As shown in FIG. 22, the fifth transistor M5 and the sixth transistor M6 are configured to act as an inverter to invert the positive data DP sampled by the third transistor M3. The gate terminal of the fifth transistor M5 is supplied by the supply voltage. According to other embodiments of the disclosure, the gate terminal of the fifth transistor M5 could be controlled by other signals.

Figure 23:
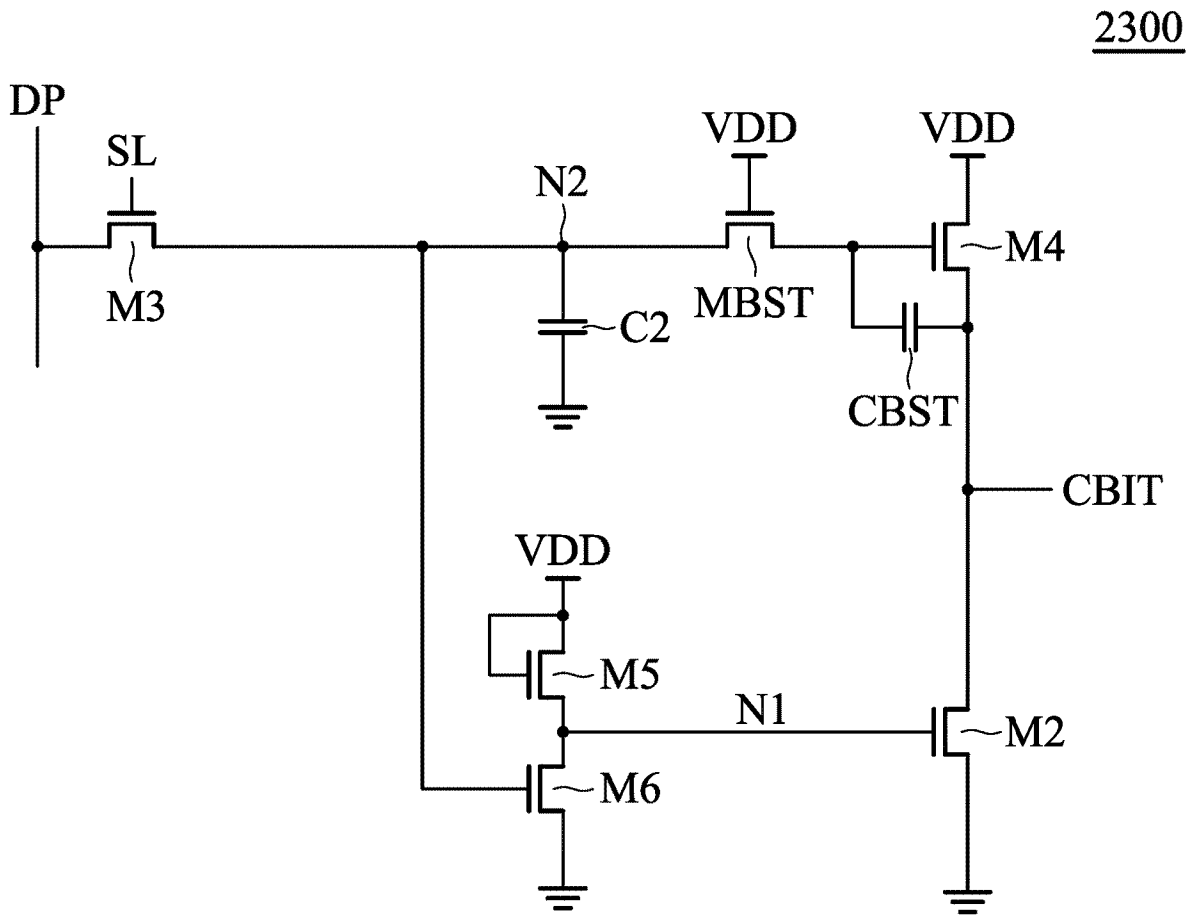
FIG. 23 is a block diagram of a latch unit in accordance with another embodiment of the disclosure.

FIG. 23 is a block diagram of a latch unit in accordance with another embodiment of the disclosure. Comparing the latch unit 2300 to the latch unit 2200 in FIG. 22, the latch unit 2300 further includes the bootstrap capacitor CBST and the bootstrap transistor MBST.

Comparing the latch unit 2300 to the latch unit 1400 in FIG. 14, all the P-type transistors of the latch unit 1400 has been converted into N-type transistors with some required modifications.

Figure 24:
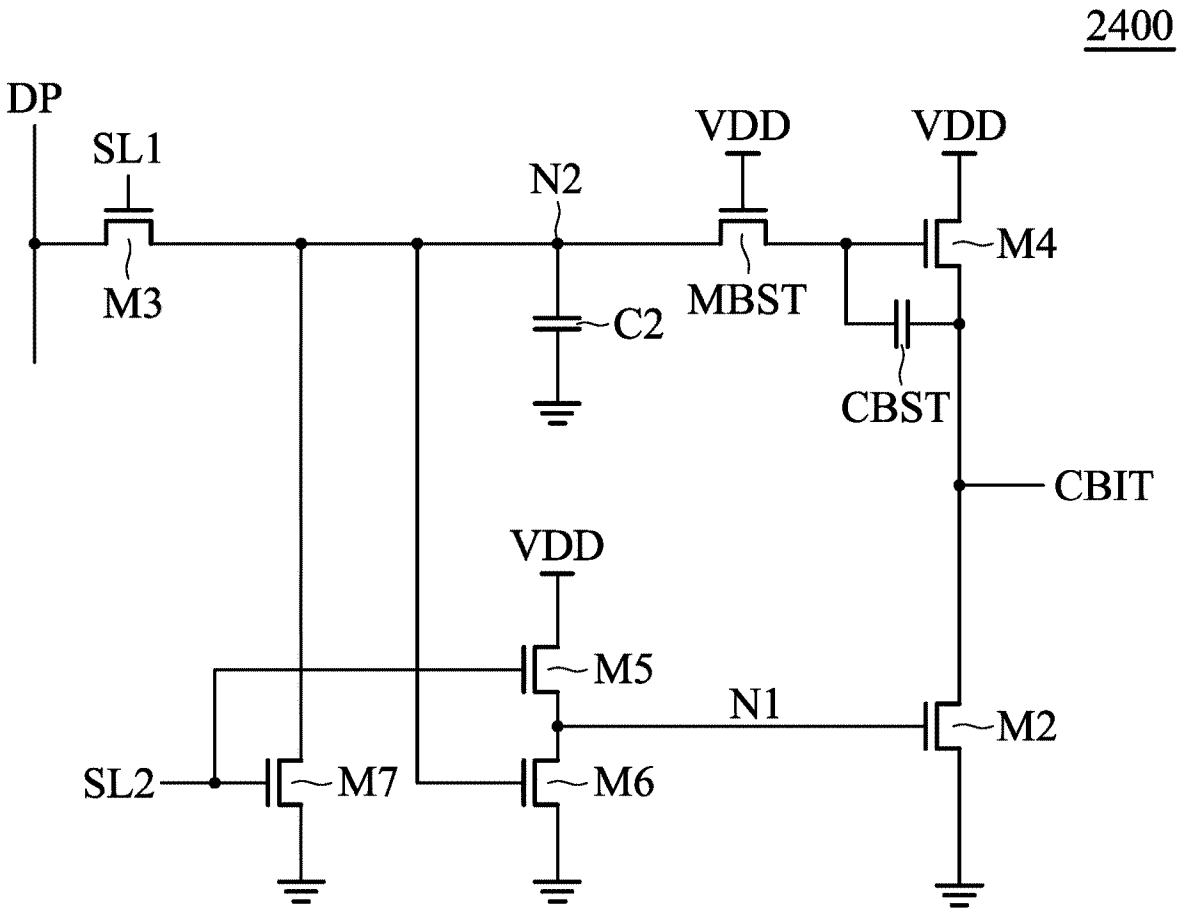
FIG. 24 is a block diagram of a latch unit in accordance with another embodiment of the disclosure.

FIG. 24 is a block diagram of a latch unit in accordance with another embodiment of the disclosure. Comparing the latch unit 2400 to the latch unit 1500 in FIG. 15, all the P-type transistors of the latch unit 1500 have been converted into N-type transistors with some required modifications.

As shown in FIG. 24, the gate terminal of the fifth transistor M5 is controlled by the second latch signal SL2, and the gate terminal of the third transistor M1 is controlled by the first latch signal SL1. As stated in FIG. 19, the first latch signal SL1 is configured to drive the first LED unit XLED1, and the second latch signal SL2 is configured to drive the second LED unit XLED2, in which the second LED unit XLED2 is illuminated prior to the first LED unit XLED1.

Therefore, the fifth transistor M5 is configured to preset the first node N1 to the supply voltage VDD according to the second latch signal SL2, and the seventh transistor M7 is configured to preset the second node N2 to the ground according to the second latch signal SL2.

While the disclosure has been described by way of example and in terms of preferred embodiment, it should be understood that the disclosure is not limited thereto. Those who are skilled in this technology can still make various alterations and modifications without departing from the scope and spirit of this disclosure. Therefore, the scope of the present disclosure shall be defined and protected by the following claims and their equivalents.

What is claimed is:

1. An LED driving circuit for illuminating a first LED unit, comprising:

a data latch circuit, latching a data signal according to a first latch signal to generate a first control signal;

a current source, generating a constant current; and a PWM circuit, comprising:

a plurality of transmission transistors, wherein each of the transmission transistors passes a corresponding bit of the first control signal to generate a PWM signal according to a corresponding bit of an enable signal;

a pull-up transistor, pulling the PWM signal to a supply voltage when all the transmission transistors are turned OFF; and a dimming transistor, coupling the current source to the first LED unit according to the PWM signal so that the constant current flows through the first LED unit;

wherein the plurality of transmission transistors, the pull-up transistor, and the dimming transistor are implemented by either P-type transistors or N-type transistors.

2. The LED driving circuit of claim 1, wherein the data signal, the first control signal, and the enable signal are N bits, wherein N is a positive integer, wherein the data latch circuit comprises N latch units and each of the latch units latches one bit of the data signal to generate one bit of the first control signal.

3. The LED driving circuit of claim 2, wherein each of the latch units comprises:

a first transistor, providing negative data from a first data bit of the data signal to a first node according to a first latch bit of the first latch signal;

a first capacitor, coupled between the first node and a ground and storing the negative data; and a second transistor, coupling a first bit of the first control signal to the ground according to the negative data at the first node.

4. The LED driving circuit of claim 3, wherein each of the latch units further comprises:

a third transistor, providing positive data from the first data bit of the data signal to a second node according to the first latch bit of the first latch signal, wherein the positive data is an inverse of the negative data;

a second capacitor, coupled between the second node and the ground and storing the positive data; and a fourth transistor, providing the supply voltage to the first bit of the first control signal according to the positive data at the second node.

5. The LED driving circuit of claim 4, wherein each of the latch units further comprises:

a bootstrap transistor, coupled between the first node and a gate terminal of the second transistor, wherein a gate terminal of the bootstrap transistor is coupled to the ground; and a bootstrap capacitor, coupled between the first bit of the first control signal and the gate terminal of the second transistor.

6. The LED driving circuit of claim 5, wherein each of the latch units further comprises:

a first preset transistor, providing the supply voltage to the first node according to a second latch signal; and a second preset transistor, providing the ground to the second node according to the second latch signal, wherein the second latch signal is configured to illuminate a second LED unit, wherein the second LED unit is turned ON prior to the first LED unit.

7. The LED driving circuit of claim 5, wherein each of the latch units further comprises:

a first preset transistor, providing the supply voltage to the first node according to a second latch signal; and a third preset transistor, providing the supply voltage to the first bit of the first control signal according to the second latch signal, wherein the second latch signal is configured to illuminate a second LED unit, wherein the second LED unit is turned ON prior to the first LED unit.

8. The LED driving circuit of claim 3, wherein each of the latch units further comprises:

a bootstrap transistor, coupled between the first node and a gate terminal of the second transistor, wherein a gate terminal of the bootstrap transistor is coupled to the ground; and a bootstrap capacitor, coupled between the first bit of the first control signal and the gate terminal of the second transistor.

9. The LED driving circuit of claim 8, wherein each of the latch units further comprises:

a first preset transistor, providing the supply voltage to the first node according to a second latch signal; and a third preset transistor, providing the supply voltage to the first bit of the first control signal according to the second latch signal, wherein the second latch signal is configured to illuminate a second LED unit, wherein the second LED unit is turned ON prior to the first LED unit.

10. The LED driving circuit of claim 3, wherein each of the latch units comprises:

a fourth transistor, providing the supply voltage to the first bit of the first control signal according to a voltage of a second node;

a fifth transistor, providing the supply voltage to the second node according to the negative data at the first node; and a sixth transistor, coupling the second node to the ground.

11. The LED driving circuit of claim 10, wherein each of the latch units further comprises:

a bootstrap transistor, coupled between the first node and a gate terminal of the second transistor, wherein a gate terminal of the bootstrap transistor is coupled to the ground; and a bootstrap capacitor, coupled between the first bit of the first control signal and the gate terminal of the second transistor.

12. The LED driving circuit of claim 11, wherein each of the latch units further comprises:

a seventh transistor, providing the supply voltage to the first node according to a second latch signal, wherein the second latch signal is configured to illuminate a second LED unit, wherein the second LED unit is illuminated prior to the first LED unit, wherein the sixth transistor pulls the second node to the ground according to the second latch signal.

13. An LED driving circuit for illuminating a first LED unit, comprising:

a data latch circuit, latching a data signal according to a first latch signal to generate a first control signal;

a current source, generating a constant current; and a PWM circuit, comprising:

a plurality of transmission transistors, wherein each of the transmission transistors passes a corresponding bit of the first control signal to generate a PWM signal according to a corresponding bit of an enable signal;

a first pull-down transistor, pulling the PWM signal down to the ground when all the transmission transistors are turned OFF; and a dimming transistor, coupling the current source to the first LED unit according to the PWM signal so that the constant current flows through the first LED unit;

wherein the plurality of transmission transistors, the pull-down transistor, and the dimming transistor are implemented by either P-type transistors or N-type transistors.

14. The LED driving circuit of claim 13, wherein the data signal, the first control signal, and the enable signal are N bits, wherein N is a positive integer, wherein the data latch circuit comprises N latch units and each of the latch units latches one bit of the data signal to generate one bit of the first control signal.

15. The LED driving circuit of claim 14, wherein each of the latch units comprises:

a first transistor, providing positive data from a first data bit of the data signal to a first node according to a first latch bit of the first latch signal;

a first capacitor, coupled between the first node and a ground and storing the positive data; and a second transistor, providing a supply voltage to a first bit of the first control signal according to the positive data at the first node.

16. The LED driving circuit of claim 15, wherein each of the latch units further comprises:

a bootstrap transistor, coupled between the first node and a gate terminal of the second transistor, wherein a gate terminal of the bootstrap transistor is coupled to the supply voltage; and a bootstrap capacitor, coupled between the first bit of the first bit control signal and the gate terminal of the second transistor.

17. The LED driving circuit of claim 16, wherein each of the latch units further comprises:

a first preset transistor, coupling the first node to the ground according to a second latch signal; and a second preset transistor, coupling the first bit to the ground according to the second latch signal, wherein the second latch signal is configured to illuminate a second LED unit, wherein the second LED unit is turned ON prior to the first LED unit.

18. The LED driving circuit of claim 16, wherein each of the latch units further comprises:

a first preset transistor, coupling the first node to the ground according to a second latch signal; and a third preset transistor, coupling the first bit of the first control signal to the ground according to the second latch signal, wherein the second latch signal is configured to illuminate a second LED unit, wherein the second LED unit is turned ON prior to the first LED unit.

19. The LED driving circuit of claim 15, wherein each of the latch units comprises:

a third transistor, providing negative data from the first data bit of the data signal to a second node according to the first latch bit of the first latch signal, wherein the negative data is an inverse of the positive data;

a second capacitor, coupled between the second node and the ground and storing the negative data; and a fourth transistor, coupling the first bit of the first control signal to the ground according to the negative data at the second node.

20. The LED driving circuit of claim 13, wherein the PWM circuit further comprises:

a second pull-down transistor, pulling the PWM signal to a ground according to a second latch signal, wherein the second latch signal is configured to illuminate a second LED unit, wherein the second LED unit is turned ON prior to the first LED unit.

* * * * *